US005668590A

United States Patent [19]

Maruo et al.

[11] Patent Number: 5,668,590

[45] Date of Patent: Sep. 16, 1997

[54] OPTICAL BEAM SCANNING SYSTEM WITH ROTATING BEAM COMPENSATION

[75] Inventors: Seiji Maruo, Hitachi; Akira Arimoto, Kodaira; Yoshihito Maeda, Mito; Tatsuya Sugita, Hitachi, all of Japan

[73] Assignees: Hitachi, Ltd.; Hitachi Koki Co., Ltd., both of Tokyo, Japan

[21] Appl. No.: 253,553

[22] Filed: Jun. 3, 1994

[30] Foreign Application Priority Data

Jun. 24, 1993 [JP] Japan ..... 5-175887
Sep. 30, 1993 [JP] Japan ..... 5-244223

[51] Int. Cl.[6] ..... B41J 2/47

[52] U.S. Cl. ..... 347/256; 359/217

[58] Field of Search ..... 347/256, 255, 347/260, 261, 241, 243, 134; 359/217

[56] References Cited

U.S. PATENT DOCUMENTS 4,920,364 4/1990 Andrews et al. ..... 347/255
5,007,692 4/1991 Matsuura ..... 359/217

*Primary Examiner*—Mark J. Reinhart
*Attorney, Agent, or Firm*—Antonelli, Terry, Stout & Kraus, LLP

[57] ABSTRACT

An optical arrangement for an optical scanning apparatus which can record a plurality of high precision information concurrently, provides for a laser beam emitted from a single light source to be polarized in two polarization directions, and each of the two polarized beams is further imparted with different information according to its polarization direction. Then, the two polarized beams are used for scanning over a photosensitive member to concurrently record respective information at different positions on the photosensitive member. In order to suppress induced light fluctuation depending on an incident angle of light on the beam splitter, an optical rotation means is provided in the optical system, such that a desired optical rotation control can be obtained corresponding to the incident angle on the beam splitter, so as to compensate for the fluctuation of light whereby the beam splitter can be arranged to be free of the influence of the incidence angle of the beam.

13 Claims, 18 Drawing Sheets

FIG. 14(a)

MULTILAYERED FILM SPECIFICATION

| | REFRACTIVE INDEX | FILM THICKNESS (nm) | THICKNESS RATIO | NO. OF FILMS |
|---|---|---|---|---|
| ZnS<br>$SiO_2$ | 2.10<br>1.38 | 100<br>249 | 1.00 | *15<br>(NOTE) |

(NOTE *:DESIGNATES NO. OF LAYERS OF MATERIAL ON THE LEFT-HAND)

PRISM SPECIFICATION

| | |
|---|---|
| MATERIALS | BK7 |
| B. A. | 54.19° |
| APEX ANGLE | 54.19° |
| CONSTRUCT | LAMINATION |

ADHESIVE'S SPECIFICATION
STYRENE ORGANIC PERXIDE
TYPE 62
n = 1.50

ADHESIVE COMPENSATING FILM SPECIFICATION

| | REFRACTIVE INDEX | FILM THICKNESS (nm) |
|---|---|---|
| $ZrO_2$ | 2.00 | 171 |

ANTIREFLECTION COATING FILM SPECIFICATION

| | REFRACTIVE INDEX | FILM THICKNESS (nm) | |
|---|---|---|---|
| $MgF_2$ | 1.38 | 141 | $\lambda/4$ |
| $ZrO_2$ | 2.10 | 195 | $\lambda/2$ |
| $Al_2O_3$ | 1.63 | 120 | $\lambda/4$ |

FIG. 14(b)

MULTILAYERED THIN FILM SPECIFICATION

| | REFRACTIVE INDEX | FILM THICKNESS (nm) | THICKNESS RATIO | NO. OF FILM LAYERS |
|---|---|---|---|---|
| ZnS<br>$SiO_2$ | 2.10<br>1.38 | 65<br>164 | 0.65 | *2<br>(NOTE) |
| ZnS<br>$SiO_2$ | 2.10<br>1.38 | 85<br>212 | 0.85 | *9 |
| ZnS<br>$SiO_2$ | 2.10<br>1.38 | 65<br>164 | 0.65 | *4 |

(NOTE *:DESIGNATES NO. OF LAYERS OF MATERIAL ON THE LEFT-HAND)

PRISM SPECIFICATION

| | |
|---|---|
| MATERIALS | BK7 |
| B. A. | 54.19° |
| APEX ANGLE | 54.19° |
| CONSTRUCT | LAMINATION |

ADHESIVE'S SPECIFICATION
STYRENE ORGANIC PERXIDE
TYPE 62
n = 1.50

ADHESIVE COMPENSATING FILM SPECIFICATION

| | REFRACTIVE INDEX | FILM THICKNESS (nm) |
|---|---|---|
| $ZrO_2$ | 2.00 | 171 |

ANTIREFLECTION COATING FILM SPECIFICATION

| | REFRACTIVE INDEX | FILM THICKNESS (nm) | |
|---|---|---|---|
| $MgF_2$ | 1.38 | 141 | $\lambda/4$ |
| $ZrO_2$ | 2.10 | 195 | $\lambda/2$ |
| $Al_2O_3$ | 1.63 | 120 | $\lambda/4$ |

OPTICAL BEAM SCANNING SYSTEM WITH ROTATING BEAM COMPENSATION

BACKGROUND OF THE INVENTION

The present invention relates to an electrophotographic recorder which is capable of handling various information, such as image information, and the like, and in particular it relates to an optical scanning apparatus which can form a high precision electrostatic latent image on a photosensitive body.

Most of the optical apparatuses for use in conventional electrophotographic recorders adopt an arrangement in which a laser beam reproduced from a single laser source carries out one-dimensional scanning via a single optical system. However, there is disclosed in J-P-A Laid-open Nos. 2-179603 and 4-305612, an arrangement in which, through light emission modulation control of a single emission source, each of a P wave and an S wave of a laser beam therefrom is caused to carry different information, then the laser beam, of which the P wave or S wave is caused to change its polarization direction by a polarization direction shift means consisting of a PLZT element, is directed along a path including a polygon mirror, an F-Θ lens and a polarizing beam splitter (PBS) in which the laser beam is split into two beams, each of which expose a photoconductor or photosensitive body.

According to the foregoing arrangement, a laser beam from the F-Θ lens enters the polarizing beam splitter at an incident angle which changes in dependence on the scanning position, however, no particular attention has been paid to the influence of the incident angle of light on the polarized light. That is, when each of two polarized beams which are orthogonal to each other is caused to carry individual information, and a PBS is used as a means to split the beam according to each polarization state, the polarization coordinate system which determines oscillatory directions of polarization for the P wave and S wave in dependence on an incident angle with respect to the polarizing beam splitter is caused to rotate. Thereby, when the coordinate system on the incidence side is assumed to be stationary, there results a misalignment between the coordinate systems of the P and S waves due to the changing incident angles. Thus, there occurs a distortion in an emitted light due to this misalignment between the coordinate systems, which in consequence prevents a laser beam printer from generating a high precision latent image in the process of forming an electrostatic latent image with such a laser beam.

SUMMARY OF THE INVENTION

An object of the invention is to propose an optimum arrangement for an optical scanning apparatus which prevents the polarization coordinate systems from varying in dependence on the incident angle of the two polarized beams of light at the time they enter the polarizing beam splitter, and a method therefor. It is another object of the invention to realize an image recording apparatus which is capable of recording a high precision image.

In order to solve the foregoing problems and accomplish the objects of the invention, an optical rotation control means is provided which can control rotation of a laser beam entering a spectroscopic means including a beam splitter and the like in dependence on its incident angle, the incident angle being determined by a scanning position of one line of scan, and the optical rotation control being carried out in response to a line synchronous signal.

As an example of an optical rotating means for use in practice there is, as an active means, one represented by a Faraday rotator which, through use of a device capable of rotating coordinates of an incident light, controls a quantity of optical rotation by dynamic control of a current flowing therethrough. Further, as a static means, an optical rotation film or liquid crystal cells having a refraction factor anisotropy and a thickness, which are both adjustable such that its phase difference becomes $\lambda/2+n\lambda$ (n:integer), may be used and arranged to have a distribution in their optical rotation axes so as to be able to distribute optical rotation quantities corresponding to respective incident positions, and thereby the optical rotation quantities may be changed according to an actual incident position.

Further, in order to minimize the influence of the optical rotation, it is most effective to increase an apex angle of the prism of the polarizing beam splitter.

As described above, without the need of modifying the conventional optical system to a great extent, a beam incident on the beam splitter is adjusted to eliminate a misregistration taking place in the optical coordinate systems, i.e., between the P wave and S wave coordinates, due to varying angles of incidence on the beam splitter. This has been attained by controlling the optical rotation of the incident beam corresponding to an incidence angle through use of an optical rotation means, thereby a desired split light beam(s) can be output from the beam splitter so as to produce a high precision electrostatic latent image, and obtain a clear printed image.

BRIEF DESCRIPTION OF THE DRAWINGS

Embodiments of the present invention will now be described in detail, by way of example, with reference to the accompanying drawings, in which:

FIGS. 14(*a*) and 14(*b*) are charts which show design data for a PBS;

DESCRIPTION OF THE PREFERRED EMBODIMENTS

First, an outline of the present invention will be described by referring to its background and, by way of example, to an optical scanning apparatus forming an embodiment of the invention as applied to a laser beam printer.

Figure 1:
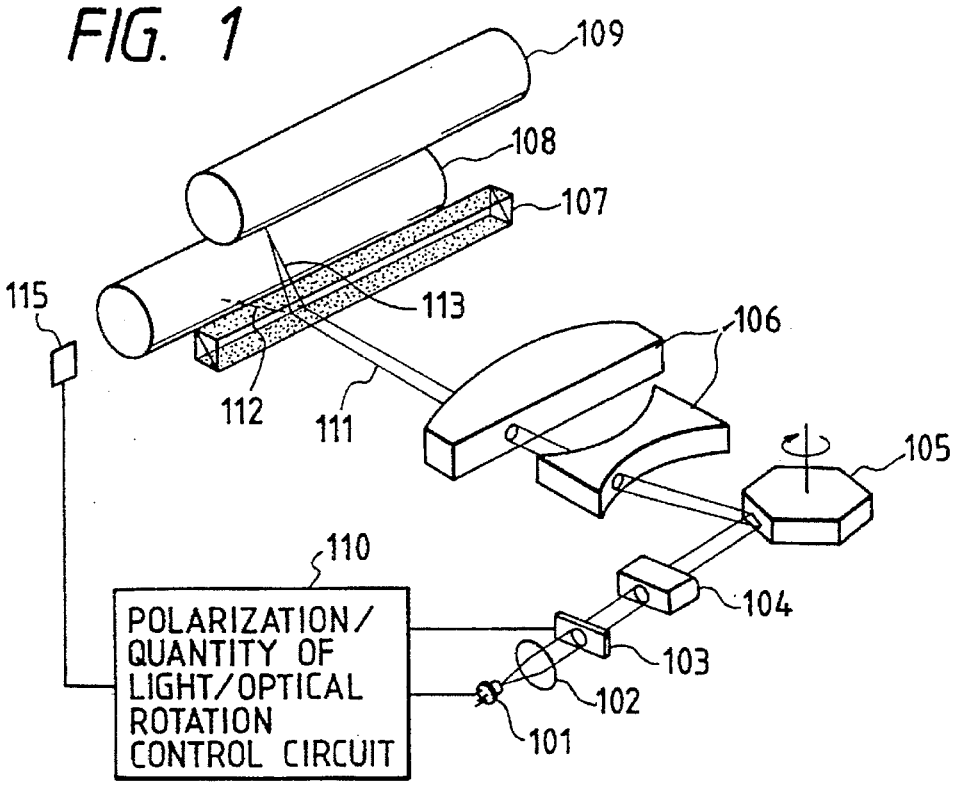
FIG. 1 is a schematic diagram showing an optical scanning apparatus forming of one embodiment of the invention.

FIG. 1 is a schematic diagram of an optical scanning apparatus forming one embodiment of the invention as applied to a laser beam printer.

With reference to FIG. 1, a single laser beam source 101 is used, and a polarization/optical rotation means 103 is disposed between the laser beam source 101 and a rotating polygon mirror 105 to change the direction of polarization in a linearly polarized laser beam. A control circuit 110, operating in dependence on information (print information) input from outside, selects an emission quantity for the laser beam and a polarized light beam (polarized P wave or S wave) which carries the input information, and then controls the emission quantity of the laser beam source 101 and the amount of its polarization in the polarization/optical rotation means 103 so as to produce a polarized light beam 111. In addition to the foregoing, the present invention is further characterized in that optical rotation information corresponding to respective scanning positions is taken into consideration together with the input information (print information) supplied from outside to control the amount of light (from the laser beam source 101) and the amount of polarization/optical rotation (in the polarization/optical rotation means 103) and an optimum polarized beam 111 is then produced. The polarized beam 111 is allowed to have both components of a polarized P wave and S wave of arbitrary amounts, i.e., it can have P and S waves as independent information. Further, in order to split the foregoing polarized light beam 111 into two components for use in exposing both of two photosensitive drums 108, 109 (which may be two different positions on the same photosensitive body), a polarized beam splitter 107, hereinafter referred to as a PBS, which transmits one of the polarized laser waves, but reflects the other one, is disposed in front of the photosensitive drums. Thereby, one of the photosensitive drums is exposed only by a polarized light beam 112 of a uni-direction, and the other one of the photosensitive drums is exposed only by another polarized light beam 113. A collimator lens 102, a cylindrical lens 104, and an F-Θ lens 106 have the same function as in the optical system in a conventional type electrophotography apparatus, that is, to focus a spot uniformly on the drums 108, 109.

Further, a line synchronization signal beam receive unit 115 is provided to receive a light signal from the rotary polygon mirror 105 when the rotary polygon mirror 105 starts its first scan pass so as to synchronize the write-start timing with the received light.

In the foregoing arrangement of the invention, an incident angle on the PBS 107 corresponding to a scanning direction of the laser beam is determined by a scanning angle of the rotary polygon mirror 105 and an output position on the F-Θ lens 106. According to the present invention, the amounts of polarization and optical rotation are adjusted corresponding to the varying incident angles with respect to the PBS 107.

In the one embodiment of the invention described in FIG. 1, the polarization/optical rotation means 103 was not described in detail, but the polarization means is provided for the purpose of arbitrarily changing the ratio of S and P components, and the optical rotation means is provided for causing a polarized light induced by the polarization means to rotate on its oscillation plane. More particularly, such means are not limited to any specific structure so long as they achieve the foregoing objects of the invention. A preferred embodiment of the invention will be discussed below, by way of example, in which a polarization means and an optical rotation means are composed separately.

As such a polarization means there may be contemplated, for example, a method which makes use of an electro-optic effect or the like, and as an optical rotation means there may be contemplated, for example, a method which makes use of a magneto-optic effect. Then, the foregoing means will be controlled by a polarization/optical rotation/light quantity control circuit 114 (FIG. 6) corresponding to a scanning position.

Since the polarization means in the polarization/optical rotation means 103 is intended to change the ratio of S/P components, it is also possible to change the ratio of S/P components by using an optical rotation means which provides a coordinate rotation. Thereby, if an optical rotation means which makes use of a magneto-optic effect is utilized, the polarization means and the optical rotation means can be incorporated into a single device. One such example will be detailed later.

Figure 2:
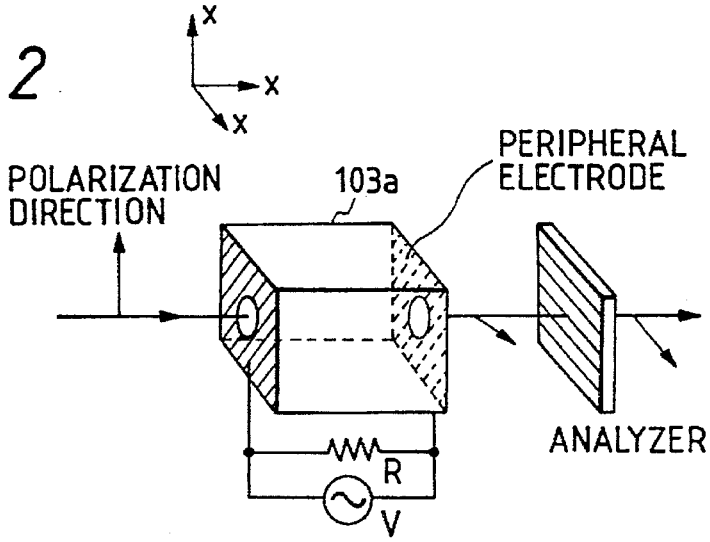
FIG. 2 is a diagram of a polarization control optical system according to the invention.

With reference to FIGS. 2 and 3, a method for generating the polarized light beam 111 according to the invention will be described. In accordance with information (print information) input from outside, an appropriate quantity of light to be emitted and a properly polarized light beam or wave (P wave or S wave) to carry the information are selected, then the quantity of light emitted (from the laser beam source 101) and the quantity of polarized light (in the polarization/optical rotation means 103) are controlled to produce the polarized light beam 111. An exemplary polarization means, making use of an electro-optic effect according to the invention, is shown in FIG. 2. As an optical modulator which makes use of the electro-optical effect there is shown in FIG. 2 a vertical type modulator in which the forward direction of light and the direction of the modulating electric field coincide, but the invention is not limited thereto, and the same effect of the invention will be achieved through use of a horizontal type modulator as well.

Figure 3A:
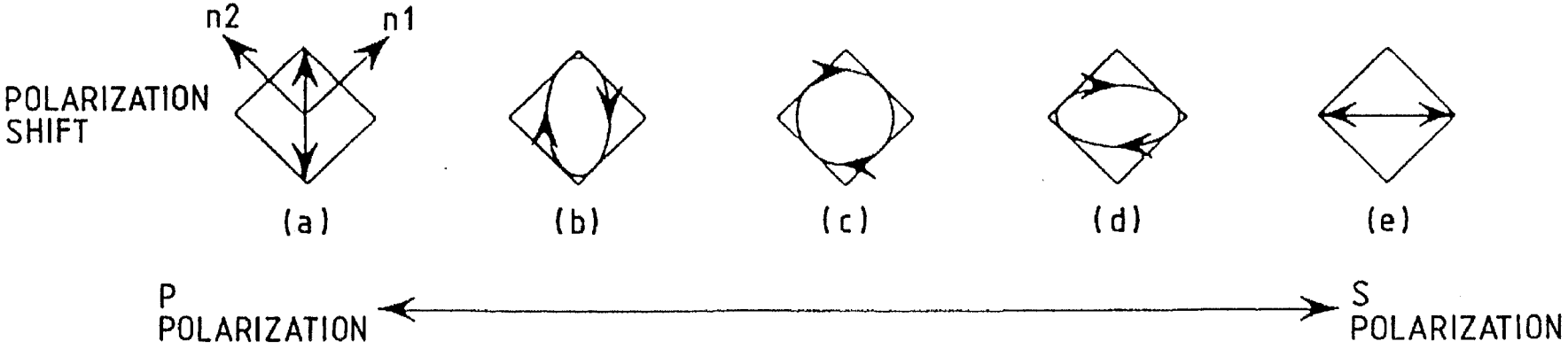
FIGS. 3A(*a*)–(*e*) and 3B(*a*)–(*d*) show examples of polarization control and optical amount control of the invention.
Figure 3B:
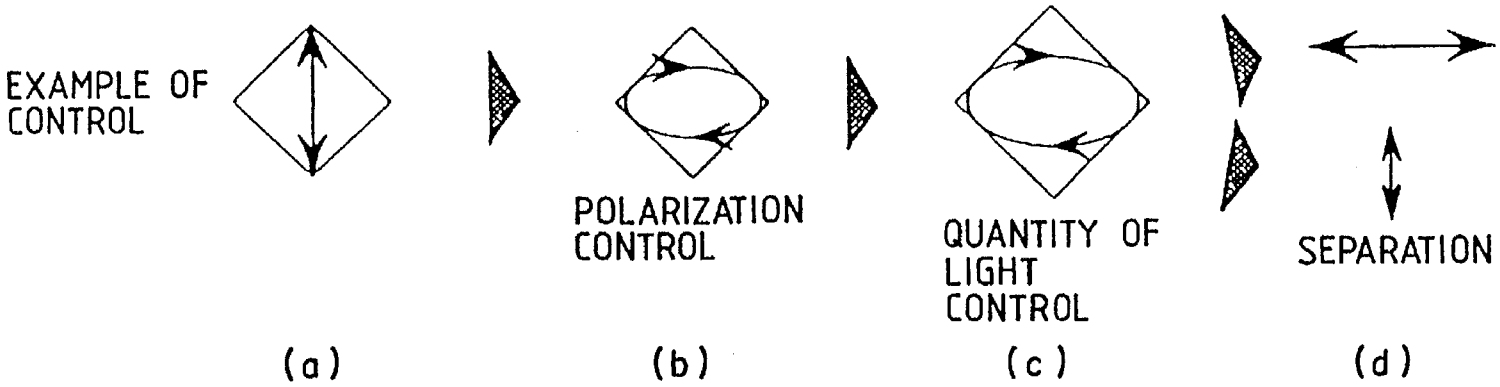

FIGS. 3A and 3B are examples illustrative of various states of controlled polarization and light quantities.

FIG. 3A shows examples of controlled polarization states, while FIG. 3B illustrates examples in which both polarization and light quantity are controlled. In particular, FIG. 3A from (a) to (e) indicates shifts in the polarization states from polarization P to polarization S. As shown in FIG. 3A(*a*), refractive indexes n1 and n2 are electro-optically controlled to have a phase difference between an n1 direction and an n2 direction such that the polarization state is caused to shift from the initial polarization P to polarization S. More particularly, a laser beam emitted from the laser beam source 101 is normally a linearly polarized beam oscillating in one direction. This beam is allowed to enter the polarization means 103*a*. Then, with reference to FIG. 2. an electric field is applied to a $Kd_2PO_4$ crystal (polarization means 103*a*) in the direction of the z axis ($X_3$), i.e., from the incidence side toward the emission direction so that the incidence beam linearly polarized either in the direction of $x_1$ or $x_2$ is allowed to propagate in the direction of $x_3$. In dependence on an applied voltage V, refractive indexes in directions slanted by +45° from axis $x_1$ are caused to change, hence the incidence beam which is caused to advance is split into two types of light beams, each having a different phase speed. Further, the control amount of applied voltage V is determined by a timing signal which is produced in response to a signal from the line synchronization signal receive unit 115, and which is set at an optical scanning start position on the photosensitive drum in FIG. 1. Namely, in order that a desired quantity of polarization is obtained with respect to the linear polarization direction, the power source voltage V is applied in a direction which makes an angle 45° with the direction in which the refractive index changes, and then polarization control is executed according to a phase difference quantity to be defined by a product of a refractive index difference Δn (Δn=n1−n2) caused by the applied voltage and an optical path length in the electro-optical device caused likewise. Through such control operations, polarization waves P and S to be defined by an incident plane at the beam splitter can be controlled to have an arbitrary ratio therebetween.

FIG. 3B(*a*)–(*d*) shows an example of an added control in which a light emission quantity control is added to the polarization control of FIG. 3A. Here, the light emission quantity control is intended to comprise a variable light intensity control while preserving its polarization state. Namely, in FIG. 3B, a polarized wave P in state (a) is subjected to a polarization control described in FIG. 3A to obtain a desired polarization quantity as shown in (b), in addition, however, the polarized light quantity of which is further subjected to light quantity control so as to obtain a desired light quantity in each polarization direction as shown in (c). According to this light quantity control, a desired light emission quantity can be obtained through control of the quantity (intensity) of emission from the laser beam source. Generally, the light beam, after being subjected to polarization and emission quantity control, is directed to the rotatory polygon mirror 105 and through the F-Θ lens 106 to the beam splitter 107, where as shown in (d) the beam is split into respective waves in respective directions of polarization. As described above, since they can be controlled to have an arbitrary ratio and an arbitrary intensity, the P polarized wave and S polarized wave can be controlled separately.

However, in the foregoing examples, the respective polarized light waves are not given of any optical rotation control, therefore, there is likely to be induced a difference in their polarization states due to changes in their incident angles onto the PBS 107 when viewed from the PBS 107 side, thereby impeding a high precision light emission therefrom.

Hence, an exemplary apparatus for executing a proper optical rotation and a method therefor will be described in the following.

Figure 4:
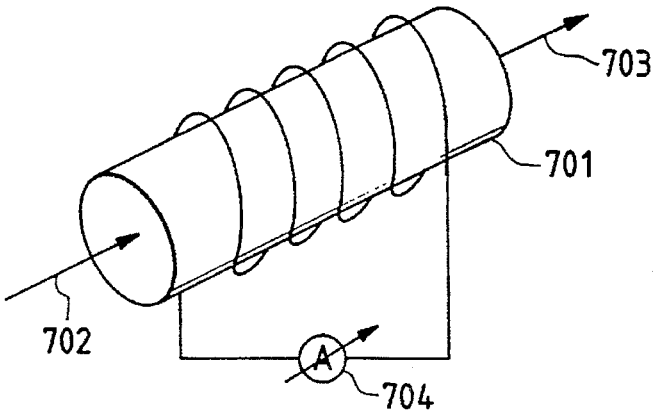
FIG. 4 is a diagram of an example of an optical rotation means of the invention.

FIG. 4 illustrates an example of an optical rotation means according to the invention which makes use of a magneto-optics effect. In this arrangement, the intensity of a magnetic field in an optical fiber (Ga-YIG) 701 having a built-in micro polarizer is controlled by adjusting the current flow using a magnetic field controller 704 in a direction parallel to the directions of an incident beam 702 and an emitted beam 703 with respect to the Ga-YIG 701 so that a desired optical rotation quantity is determined. This optical rotation means of the invention can provide the combined functions of the polarization means and the optical rotation means. Further, when combined with the foregoing polarization means, it can simplify the control and provide a high precision optical rotation control. In addition, when a compacter apparatus is required, this optical rotation means, which makes use of a magneto-optic effect, may be arranged to serve as the polarization means as well. The optical rotation means are not limited to the foregoing, but there may be other modifications within the scope of the present invention, some of which will be recited later.

Figure 5A:
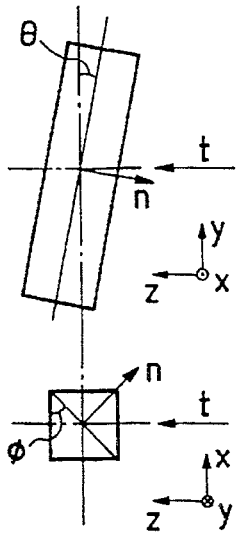
FIGS. 5A–5B show optical rotation coordinates for explaining the invention.
Figure 5B:
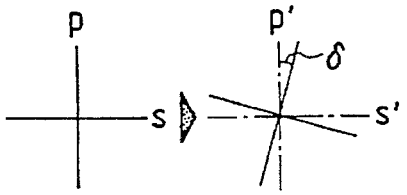

FIGS. 5A and 5B show optical rotation coordinate systems according to the invention. Generally, it is known that the incident angle of an incident light changes with respect to the PBS 107 when the light is scanned by a rotary polygon mirror. The coordinate systems in FIGS. 5A and 5B indicate examples where it is assumed that the PBS 107 is rotated and an incident vector is set constant. The foregoing coordinate systems are used to simplify the explanation, and their optical rotation quantities are assumed to be equivalent.

In FIGS. 5A and 5B, Θ: deflected incident angle on PBS, ϕ: apex angle of prism, t: vector of incident light beam, u: normal line vector normal on thin film plane, and n: refractive index of PBS. Further, the construction of PBS 107 will be discussed later in detail with reference to FIG. 11.

In addition, u=(sinϕ, -cosϕ.sinΘ, -cosϕ.cosΘ), and t=(0, 0,1).

Here, assuming that the S polarization component of the incident light in the dielectric multilayered thin film surface of the PBS 107 is (α, β, γ), then the oscillation direction of the S component will be expressed as follows, since it is defined to have its oscillatory direction within the dielectric multilayered thin film:

$$s.t=s.u=0$$

$$\alpha^2+\beta^2\gamma^2=1$$

These equations can be solved as follows:

$$\alpha=(1+(\sin\phi/(\cos\phi.\sin\Theta/n))2)\ -0.5$$

$$\beta=(\sin\phi/(\cos\phi.\sin\Theta/n))\alpha.$$

Namely, the oscillatory directional coordinate system of the incident light is transformed to a coordinate system which is rotated by $\delta=\tan^{-1}(\alpha/\beta)$. That is, in order for the PBS 107 to be able to fully demonstrate its inherent performance in separating P/S polarized beams, it becomes necessary to control the P/S polarization coordinate systems of the incident light to rotate by δ corresponding to a polarized incident angle Θ or to compensate for the rotation by δ of the oscillatory directional coordinate systems.

The foregoing detailed description of the optical rotation control has been made in particular with respect to its optical arrangement and function. Next, a preferred embodiment of the optical rotation control will be detailed in the following. In the example described below, the optical rotation means makes use of a magneto-optic effect.

Figure 6:
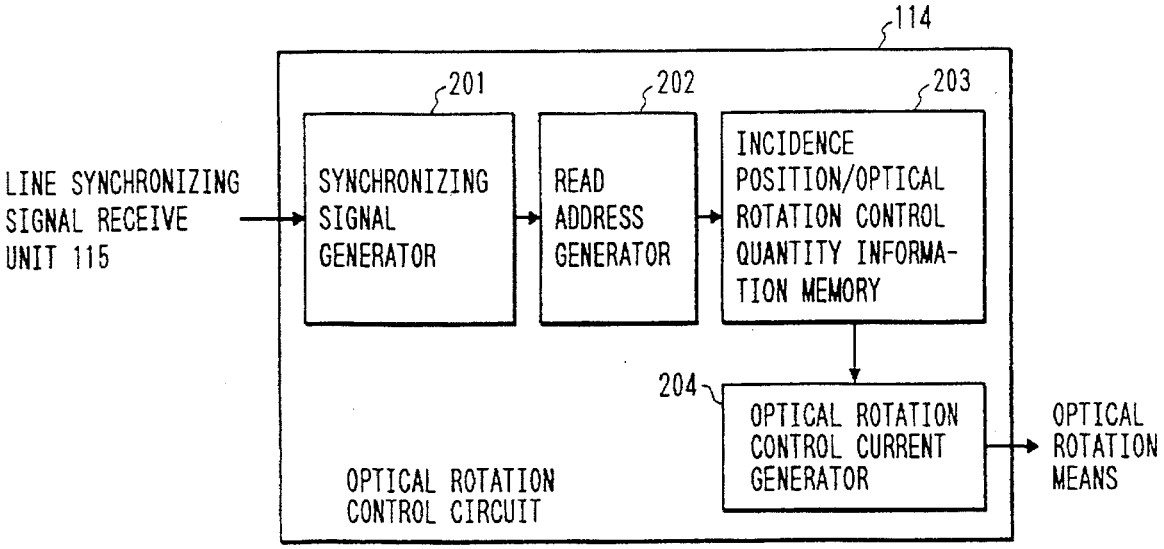
FIG. 6 is a block diagram of an example of an optical rotation control circuit of the invention.

FIG. 6 is a schematic diagram illustrative of an example of an optical rotation control circuit of the invention.

In FIG. 6, a signal from a line synchronization signal receive unit 115 is input to a synchronization signal generator 201 in which a line synchronization signal is generated. This line synchronization signal is input to a read-address generator 202. Upon inputting of the foregoing line synchronization signal, the read-address generator 202 starts outputting an address output signal corresponding to each line of information already stored in an incident position-optical rotation control quantity information memory 203. That is, the line synchronization signal serves as a reset signal for resetting the address signal generation in the read-address generator 202. Further, the incident position-optical rotation control quantity information memory 203 stores in advance information on respective incident positions and optical rotation control quantities, and in response to an address signal designated in the aforementioned read-address generator 202, outputs information corresponding to the address signal designated. Then, an optical rotation control current generator 204 carries out current control for generating magnetic fields in accordance with the output information.

The optical rotation means shown in FIG. 4, which has been described schematically hereinabove by way of example, makes use of a magneto-optical effect, but it is not limited thereto, and it should be understood that there are various modifications and variations of the optical rotating means within the scope of the present invention. Some examples will be described in detail in the following.

Means for realizing optical rotation control can be grouped roughly into two types, as recited previously: a dynamic method which makes use of a magneto-optic effect etc., and a static method which makes use of an optical rotation film which has distributed optical rotation characteristics.

With respect to the dynamic method which makes use of a magneto-optic effect, there may be contemplated variations of Faraday devices, such as a magneto-optical element which makes use of a bulk type, a fiber type, or a wave-guide type method. Further, it may be contemplated that a $\lambda/2$ wave plate or the like is rotated in synchronization with a scan cycle. Still further, the same effect of the invention may also be attained by rotating the laser beam source 101 in synchronization with a scan cycle, with the $\lambda/2$ wave plate or the like being fixed. In the following, these methods will be detailed with reference to particular examples and drawings.

Figure 7:
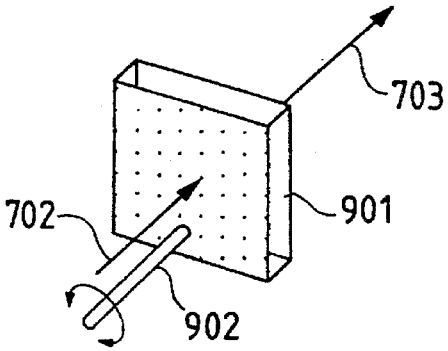
FIG. 7 is a block diagram which shows optical rotation means 2 of the invention.

FIG. 7 shows another example of an optical rotation means of the invention. A phase difference plate 901, such as a $\lambda/2$ plate which is adjusted to the particular wavelength in use, is caused to rotate around an axis of rotation 902 as much as by $\Theta/2$ of an optical rotation amount that is required, whereby an incident light beam 702 is rotated to output a desired emitted light. The advantage and effect of the invention reside in that an optimum control of optical rotation can be achieved through a very simple control operation, such as rotation, vertical or horizontal movement of the optical device.

Next, with respect to the static method which makes use of an optical rotation film, a phase compensation film that is used in liquid crystal displays or the like can be used as a $\lambda/2$ wavelength plate by adjusting its parameters. In this instance, in order to provide a distribution in optical rotation quantities, it is necessary to make the molecular directions variable since the axial direction of molecules formed by drawing becomes an axis of optical rotation.

Figure 8A:
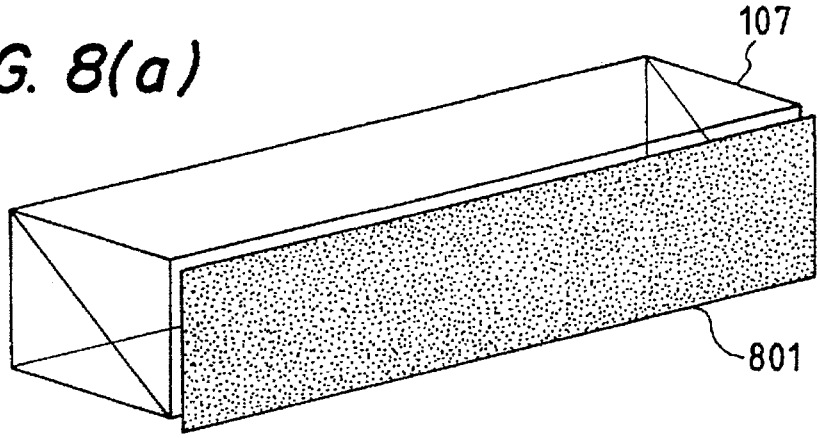
FIGS. 8(*a*) and 8(*b*) are a diagram which shows optical rotation means 3 of the invention.
Figure 8B:
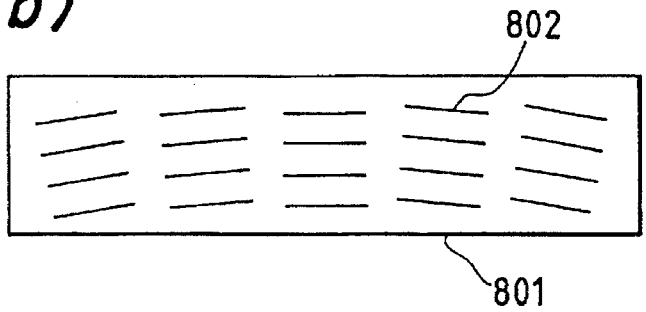

An example which makes use of an optical rotation film 801 is shown in FIGS. 8(*a*) and 8(*b*). In FIG. 8(*a*), the optical rotation film 801 is disposed on one side of a polarized beam splitter 107 facing the direction of the incoming incident beam. In the optical rotation film 801 used here, shown in FIG. 8(*b*), polymers 802 have their molecular axes oriented by drawing, thereby there arises a difference in the refractive indexes between its major axial direction and minor axial direction as a result of the oriented molecular axes. Thus, by adjusting this difference in the refractive indexes and the thickness of the film, a desired phase difference is caused to occur in the incident laser beam. That is, through adjustment of the refractive index difference and the film thickness, the same optical rotation is given with respect to the molecular axis as by the $\lambda/2$ plate. Further, in order to provide a predetermined distribution in the optical rotation quantities in the optical rotation film, it is necessary to distribute the molecular axes in predetermined directions. For this purpose, it is contemplated that, after deforming a base material, such as by annealing or the like, to a degree in which the molecular orientation will not be disturbed, a necessary portion thereof is cut out.

The advantage of this method resides in that a low-cost optical rotation film widely used in liquid crystal displays and the like may simply be disposed and there is no need for any particular additional control.

Alternatively, there may be contemplated use of liquid crystal cells aligned in a simple parallel orientation. In this instance, the axial direction of molecular orientation can be determined without using heat, but by regulating its rubbing direction.

The advantage of this alternative method described above is that it has the same effect as the optical rotation film, and that setting of the direction of the orientation axis is simple.

We have discussed hereinabove various types of optical rotation means from various aspects of their merits. In consideration of the overall performance, including such factors as high speed processing of the image data, easiness-to-manufacture, applicability and the like for application to a laser beam printer, the following optical systems are deemed to be very promising.

Firstly, as a polarization device, an electro-optic (EO) device which makes use of an electro-optic effect is promising irrespective of whether it involves a bulk, fiber or waveguide. However, since the device tends to be elliptically polarized when polarization control is applied and is unable to correspond to an optical rotation axis by itself, it must be utilized in conjunction with a Faraday rotator or the like as described above. In such instances, there are such disadvantages that the device construction is likely to become large and complex, and that if a bulk magneto-optic element is used, a large driving current is needed, thus making it difficult to achieve high speed control. In order to overcome the foregoing problems, a $\lambda/4$ plate, which has its axis of light tilted 45° relative to the axis of light of an EO device and is matched to the wavelength in use, may be disposed on the emission side of the EO device. Through the aforesaid arrangement, a light beam passing through the $\lambda/4$ plate is linearly polarized in an oscillatory direction, which is determined by a ratio of components between the major axis and the minor axis in an elliptic polarization beam, thus becoming capable of corresponding to a rotation of the axis of light.

Figure 9:
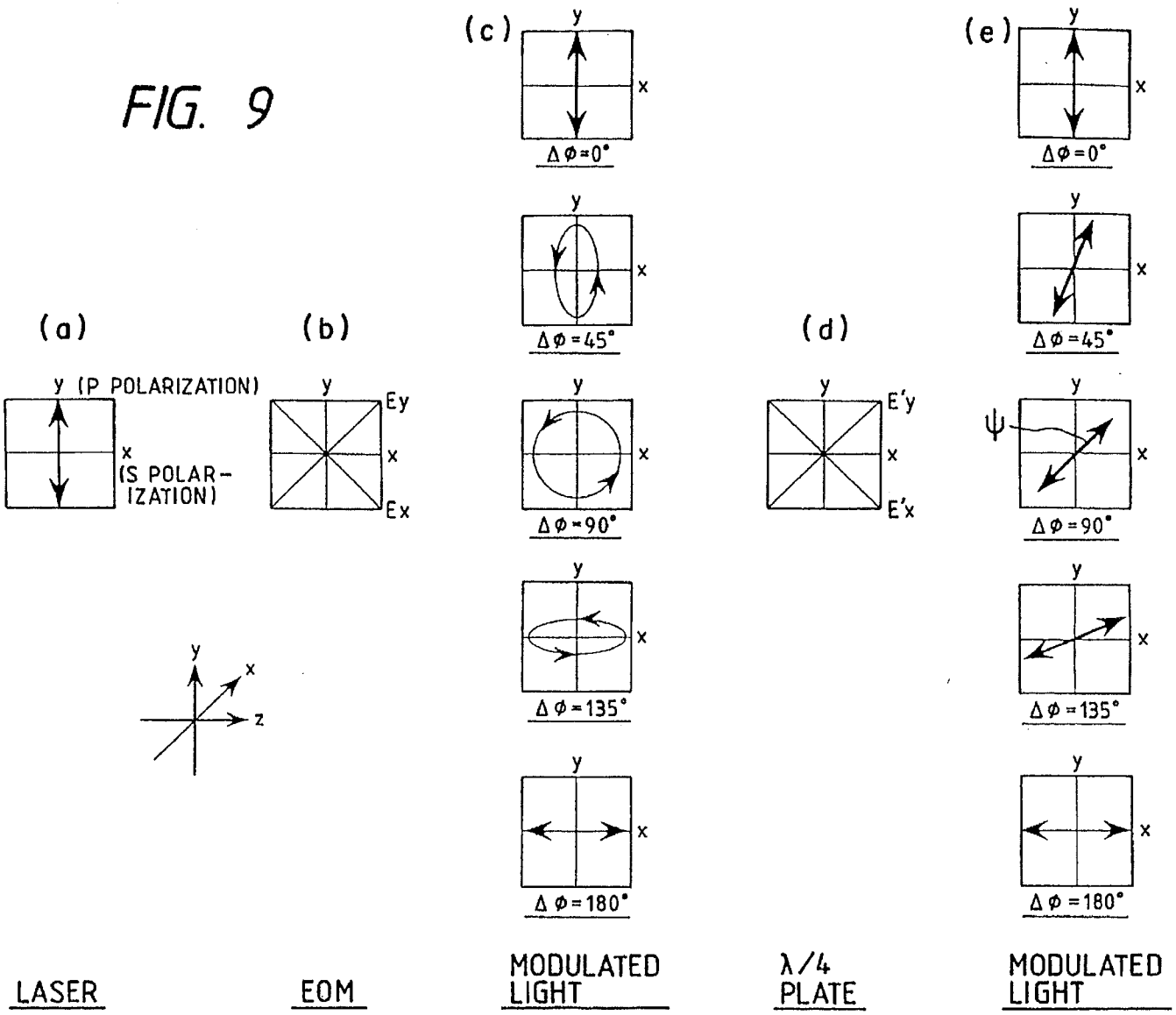
FIGS. 9(*a*)–9(*c*) are a diagram which illustrates optical arrangements of a polarizer member of the invention.

An example of an optical rotation means of the invention which makes use of the foregoing arrangement will be discussed in detail in the following. Firstly, an optical arrangement of the invention is assumed with reference to FIGS. 9(*a*)–9(*c*), wherein in FIG. 9(*a*) a $\lambda/4$ plate, in which crystal axes E'x.E'y are set in the same directions as crystal axes in the electro-optic modulator element, is disposed after the electro-optic modulator. Generally, an elliptic polarization is a polarization produced by the overlapping of two linearly polarized light beams which oscillate in directions of x or y axes, respectively, and have a phase difference of $\pm\pi/2$ therebetween. Namely, an incident light E' is given by the following formulas:

$$E'=E'x+E'y$$

$$E'x=Axe\ (i\tau e\pm\pi/2)$$

$$E'y=Ay\ (ei\tau)$$

where, $\tau$ is a phase term which can be expressed by the following equation:

$$\tau=\omega t-(2\pi/\lambda 0)nx+\phi$$

where, $\omega$: angular frequency, t: time, $\lambda 0$: wavelength in vacuum, n: refractive index of medium, $\phi$: initial phase. When this light beam passes through the $\lambda/4$ plate, a phase $\pi/2$ is further added thereto making its phase $\pi$ or 0, thereby in consequence it becomes a linearly polarized light. Assuming its direction to be $\psi$, we obtain, $$\tan\psi=Az/Ay$$

As described above, by shifting the elliptic polarization output from the electro-optic modulator to the linearly polarized light by means of the $\lambda/4$ plate, and by variably modifying the polarization control quantity corresponding to the incident angle $\Theta$, it becomes possible to compensate for the rotation of the coordinate axes of P/S polarization waves corresponding to the deflected incident angle $\Theta$.

The foregoing methods described heretofore are concerned with the optical rotation control or compensation methods which made use of the optical devices, however, the invention is not limited thereto, and the following method may also be contemplated to the same effect of the invention which makes use of a spectroscopic method which can reduce the influence of optical rotation. More particularly, it relates to the design requirements for a PBS.

Figure 10A:
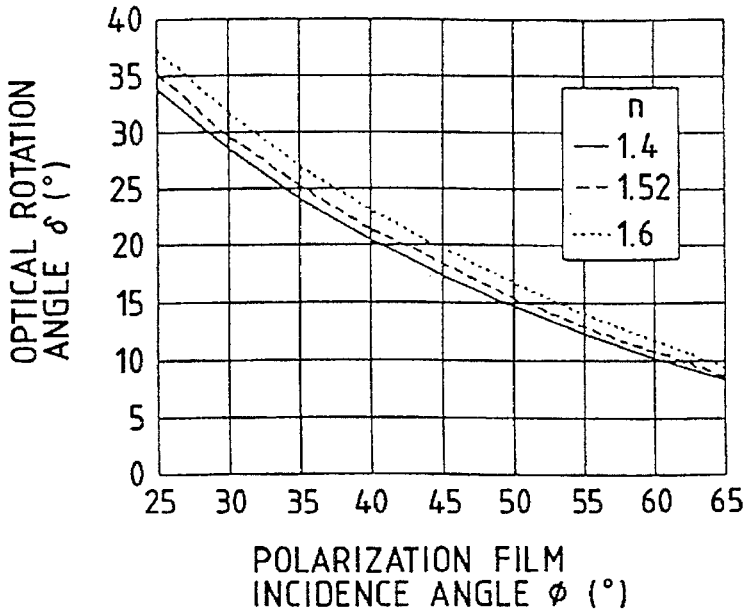
FIGS. 10A–10D are characteristic diagrams which show conversion characteristics of polarizing incident angles versus optical rotation/extinction for explaining the invention.
Figure 10B:
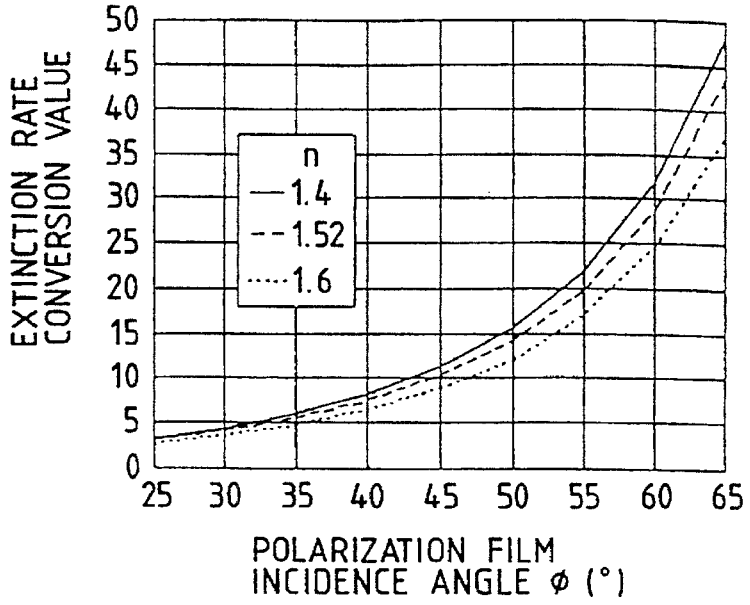
Figure 10C:
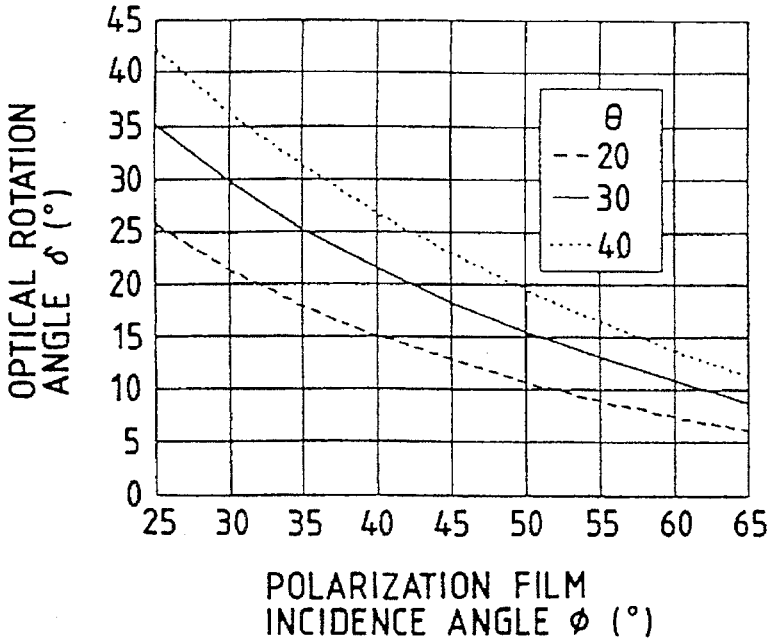
Figure 10D:
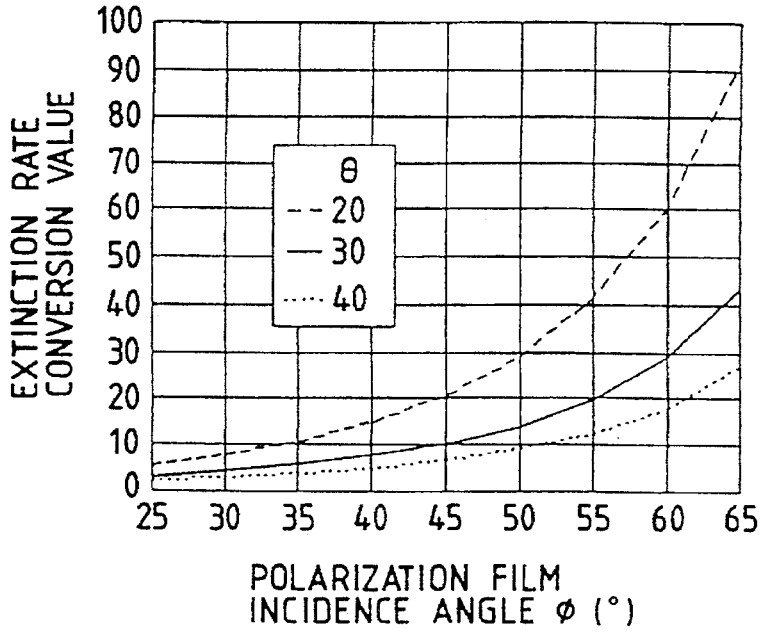

FIGS. 10A–10D show the results obtained concerning the characteristics of polarization film incident angles vs. optical rotation quantities/extinction rate conversion values. Here, the polarization film incident angle $\phi$ denotes an angle formed between a normal line of a multilayered thin film plane and an incident light which impinges on the prism perpendicular thereto (polarization incident angle $\Theta=0$). This is normally set at the same angle as an apex angle of the prism. FIGS. 10A–10C show the polarization film angle vs. optical rotation angle characteristics which are calculated by the foregoing equations. In FIG. 10A, the polarization incident angle $\Theta$ was fixed at 30°, and parameters n denote refractive indexes of optical glass of the prism. In FIG. 10B, the refractive index of the prism was fixed at 1.52(BK7), and polarization incident angles $\Theta$ were varied as parameters. In FIG. 10B and 10D, extinction rate conversion (reduced) values which are expressed by the following relationship are shown on the basis of leakage light resulting from the optical rotation:

Extinction rate reduced value=

Initial light quantity/optical rotation leakage quantity.

As shown in FIGS. 10A–10D, degradation of performance can be suppressed by increasing a receive plane $\phi$ of the thin film surface with respect to the incident light. For instance, in application to the scanning optic system of the laser beam printer in FIG. 1, an incident angle $\Theta$ for a normal spectroscopic unit being in a range of $20°\leqq\Theta\leqq 20°$, it is required, in order to meet a target for the extinction rate of 50:1, only to satisfy the condition that $\phi\geqq 55°$. As obviously understood from FIGS. 10A–10D, the influence of optical rotation can be minimized by increasing the polarization incident angle $\phi$.

If the aforesaid PBS 107 is used, the polarization means of the invention alone may permit omitting use of an optical rotation method.

Described above are the details of the optical rotation control and its compensation. In the description above it was assumed that the performance of PBS was not influenced by the deflection incident angle. In practice, however, when the deflection incident angle varies greatly, it is difficult to insure a desired P/S polarization separation performance to be maintained.

A detailed construction of a PBS according to the invention will be discussed below, as well as a solution to overcome the foregoing problem (how to ensure P/S polarized beam separation performance under a varying deflected incident angle).

With reference to FIGS. 11A–11D, there are shown basic structures of a polarized beam splitter 107 forming one embodiment of the invention. There are also shown variable states of an incident beam according to the invention.

Figure 11B:
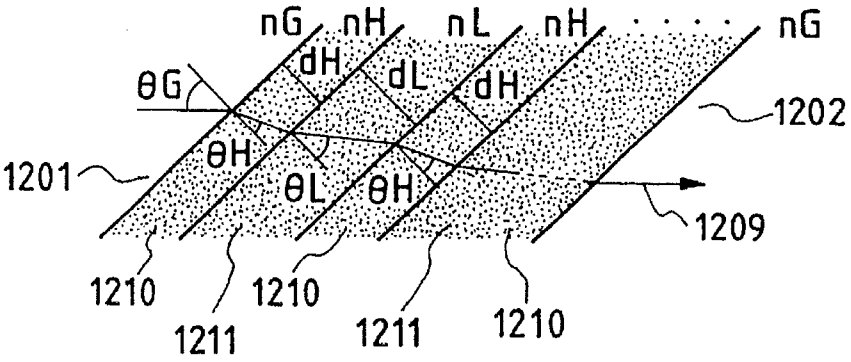
FIGS. 11A–11D are schematic diagrams illustrating basic arrangements of the PBS of the invention.
Figure 11D:
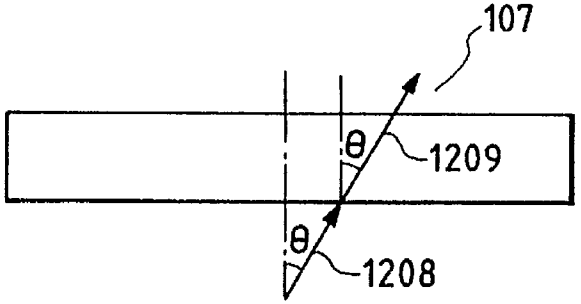
Figure 11A:
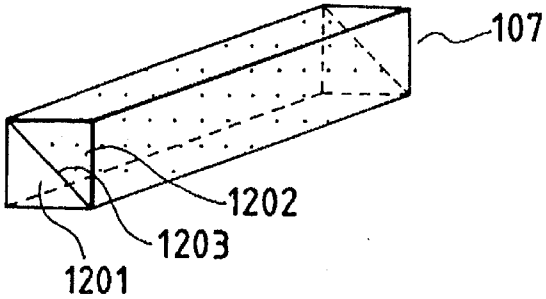

FIG. 11A is a perspective view of the polarized beam splitter of the invention. A multilayered thin film 1203, which combines optical thin films having a low refractive index and a high refractive index, is deposited by evaporation on the surface between triangular pole prisms 1201 and 1202.

FIG. 11B is the detail view of the multilayered thin film 1203, which has an arrangement such that dielectric thin films of a high refractive index thin film 1210 and a low refractive index thin film 1211 are disposed alternatively. This multilayered film arrangement has been designed to satisfy a Brewster condition. The Brewster condition refers to a condition which provides that, when a light enters from a medium with a refractive index n1 to a medium with a refractive index of n2, and when an incident angle $\phi$ of an incident light 1204 is assumed to be its Brewster angle, a P polarization component which is reflected on their boundary surfaces can become zero. The Brewster angle $\phi$ is defined as follows.

$$\phi=\tan^{-1}(n2/n1)$$

That is, it is arranged such that while P polarization is allowed to pass through, S polarization is partially reflected therefrom. Assume that a refractive index of the high refractive index layer is $n_H$, the thickness thereof is $d_H$, the refractive index of the low refractive index layer is $n_L$, the thickness thereof is $d_L$, and the refractive index of the prism is $n_G$. When an incident light enters at $\Theta_G$ with respect to the first layer of the multilayered film, and the Brewster condition is satisfied with respect to each boundary of the multilayered film, there holds, $n_H/\cos\Theta_H=n_L/\cos\Theta_L$. Also from the refractive laws of Snell, there holds $n_H\sin\Theta_H=n_L\sin\Theta_L=n_G\sin\Theta_G$. A wavelength $\lambda$ for use in writing with a light beam in an electrophotography printer is in a range of 300–1000 nm, and normally a particular wavelength $\lambda_0$ in the forgoing range is used. Since the polarization prism is used with the particular wavelength ($\lambda_0$), reflected S polarized components can be mutually augmented by means of a multilayered film, the effective optic film thickness (nd) of which is made less than $\lambda_0/4$. Further, reflection of P components occurring on both sides of the boundary between the prism and the multilayered film can be cancelled out by interference through an arrangement in which each reflected beam which is reflected from both sides of the incident plane has an opposite phase with respect to each other. A practical arrangement of a multilayered film which satisfies such conditions is exemplified by the arrangement described in the first embodiment of the invention in which films having a high refractive index and a low refractive index are disposed alternatively in repetition, and which includes such as m power of (LH), m power of (0.5HLO.5H), m power of (0.5LHO.5L), etc. Further, each film thickness of the high and low refractive index films satisfies the following condition.

$$n_H d_H \cos\Theta_H = n_L d_L \cos\Theta_L = \lambda_0/4$$

Further, the reflection coefficient of a film of q-th layer is expressed by equation 1:

$$R = \left( \frac{\eta_0 - (\eta_H^2/\eta_0)\ (\eta_h/\eta_L)^{q-1}}{\eta_0 - (\eta_H^2/\eta_0)\ (\eta_h/\eta_L)^{q-1}} \right)^2 \quad \text{(eq. 1)}$$

where, $\eta_P = n_i/\cos\Theta_i$, $\eta_s = n_i.\cos\Theta_o$, and $n_i$=a refractive index of medium i, $\Theta_i$=a refractive angle in medium i.

Figure 11C:
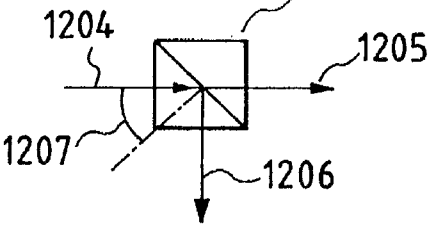

With reference to FIG. 11C, which is a side view, a beam 1204 incident on the prism with an incident angle $\phi$ is split into a transmitted light 1205 which is normally P polarized and a reflected light 1206 which is normally S polarized. In the embodiments of the invention described below, the incident angle in the $\phi$ direction is assumed to be constant. Namely, the incident angle $\phi$ 1207 is the same as an apex angle of the prism.

With reference to FIG. 11D, which is a plan view, there will be discussed another embodiment of the invention in which an incident angle in the direction $\Theta$ is set to be variable when an incident beam (1) 1208 is assumed to enter at a deflected angle $\Theta$. Its actual incident angle on the multilayered thin film 1203 enters as an incident beam (2) 1209 refracted at the surface of the prism 1201 according to Snell's law.

Figure 12:
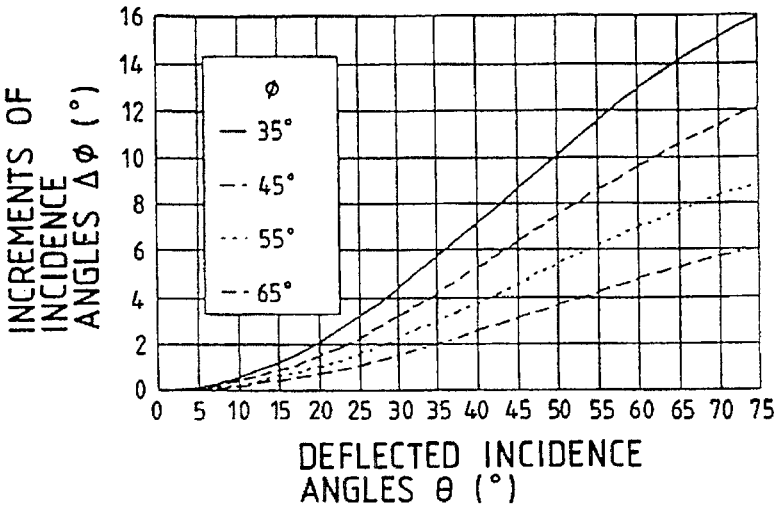
FIG. 12 is a characteristic diagram indicating polarization incident angles versus increases of incident angles.

In the optical systems of the invention, it is necessary to take into consideration variations in the incident angles with respect to the multilayered thin film surface due to the deflected scan incidence of the laser beam. FIG. 12 is a diagram showing the deflected incident angle $\Theta$ vs. incident angle increment characteristics.

In this optical system, since the multilayered thin film does not have a refraction factor anisotropy, a beam incident on the multilayered thin film 1203, which is variable in the direction $\Theta$, can be converted to an angle relative to the normal line of the thin film surface. That is, an increase in the deflection angle $\Theta$ can be expressed by an increment $\phi'$ of the incident angle $\phi$. In other words, it is equivalent for the incident beam after its conversion to the $\phi$ direction to consider that it enters at $\phi'$ which can be expressed as follows, in which $n_G$ denotes a refractive index of optical glass of the prism:

$$\phi = \cos^{-1} \frac{(\cos\Theta'\sin\Theta)}{((\cos\Theta'\cos\phi)^2 + (\cos\Theta'\sin\phi)^2 + \sin\Theta')^{0.5}} \quad \text{(eq. 2)}$$

$$\sin\Theta = n_G \sin\Theta'$$

where, an increment $\Delta\phi$ of the incident angle is defined as follows:

$$\Delta\phi = \phi' - \phi$$

In the event described above, the smaller the increment $\Delta\phi$, the more the influence of the deflected incident angle $\Theta$ can be reduced, with the result that it becomes easier to compensate the extinction rate performance. As is obvious from FIG. 12, $\Delta\phi$ increases with an increasing deflected incident angle $\Theta$. However, $\Delta\phi$ can be suppressed from increasing with an increasing incident angle $\phi$ (i.e., Brewster angle: b.a.) with $\Theta$=0.

Figure 13A:
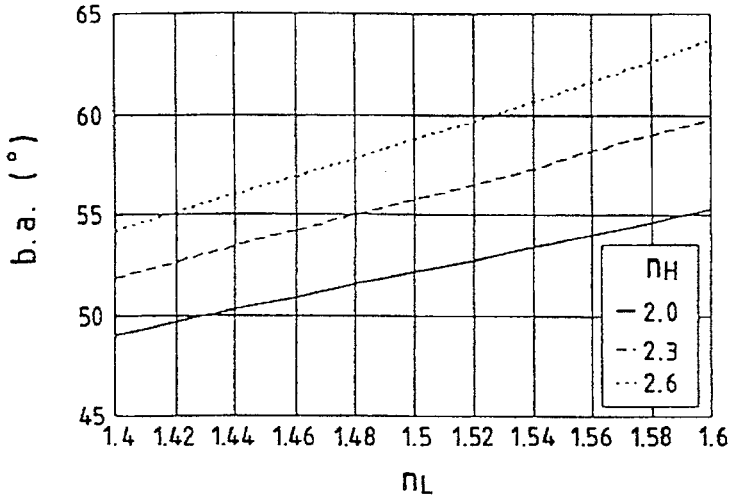
FIG. 13(*a*) and FIG. 13(*b*) are characteristic diagrams which indicate material versus b.a. characteristics.
Figure 13B:
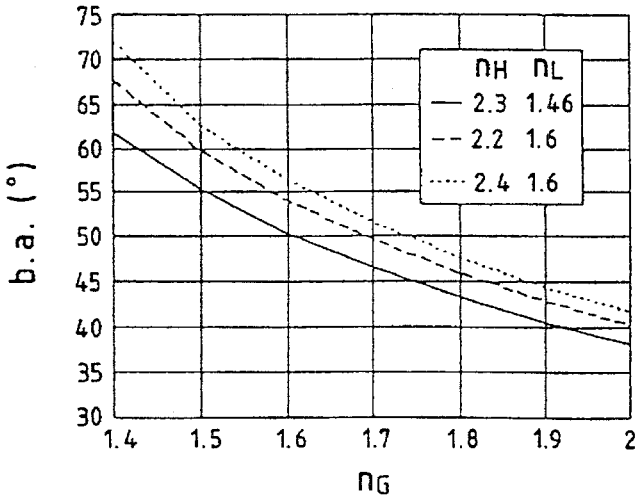
Figure 15A:
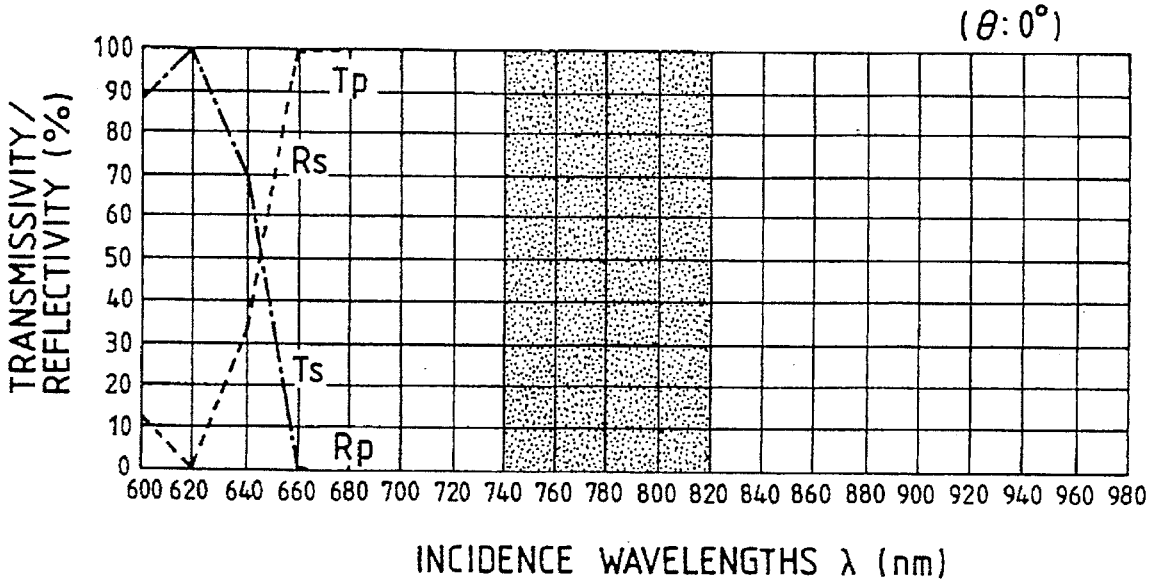
FIG. 15(a) PRIOR ART
FIGS. 15(*a*)–15(*d*) are diagrams which show results of simulations.
Figure 15B:
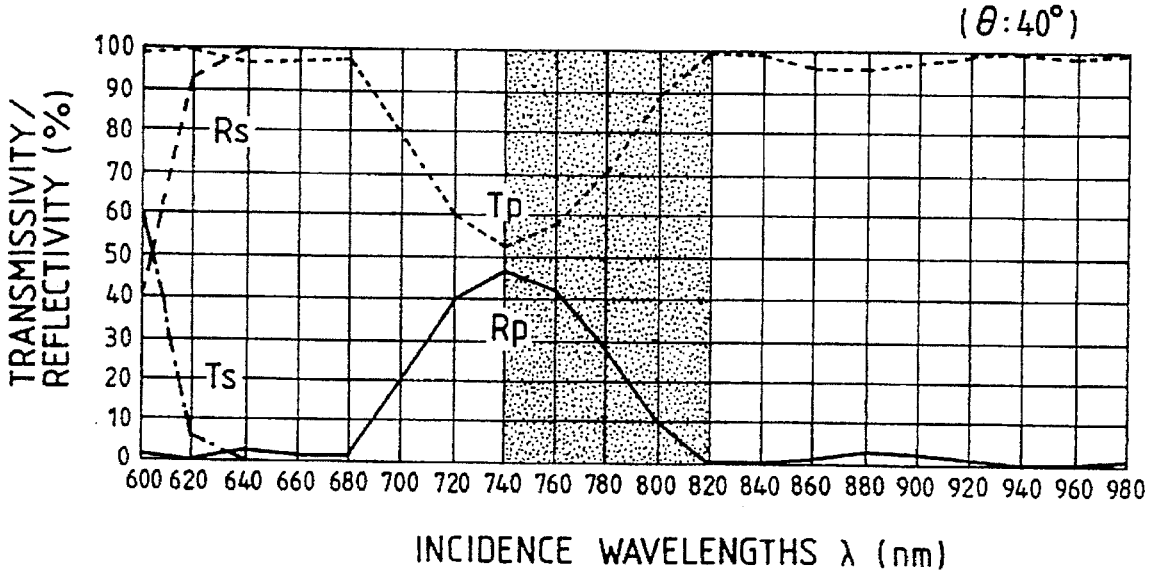
FIG. 15(b) PRIOR ART
Figure 15C:
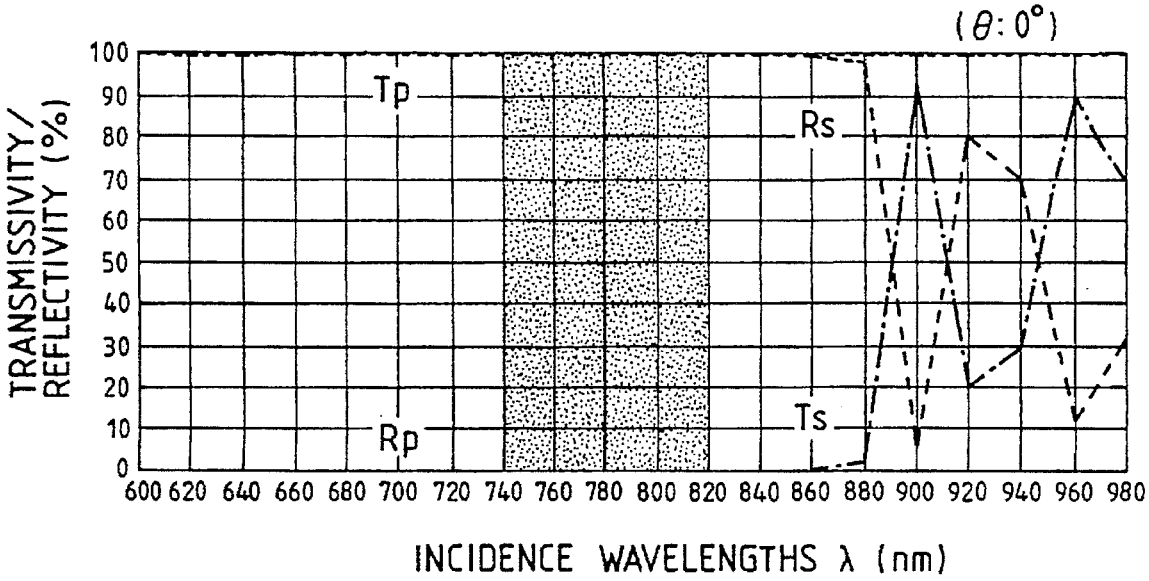
Figure 15D:
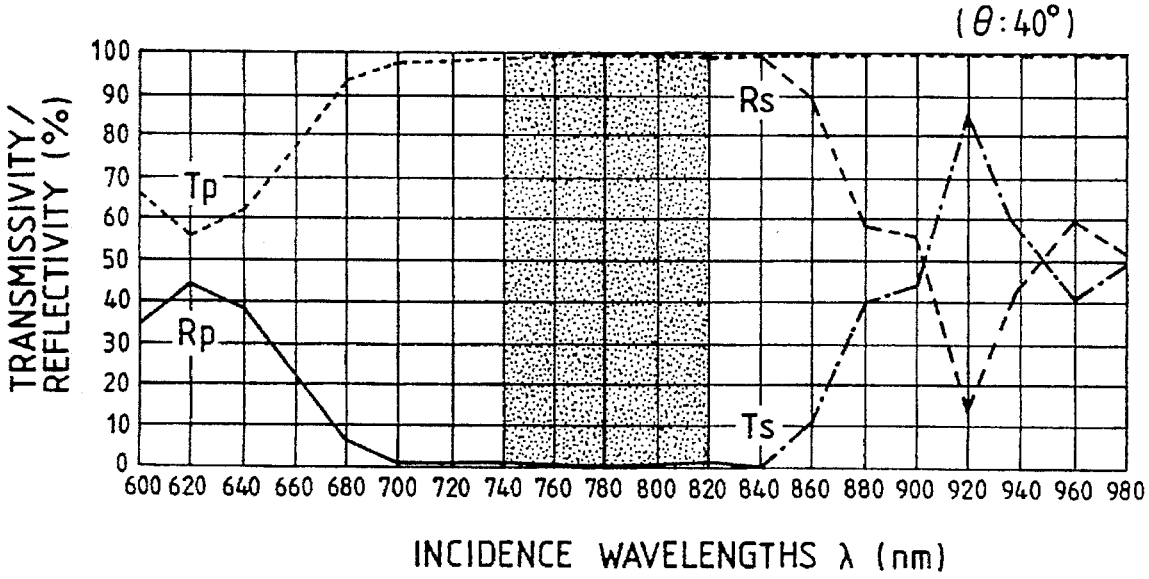

FIGS. 13(*a*) and 13(*b*) show relationships between $n_L$, $n_H$, $n_G$ and b.a. FIG. 13(*a*) shows $n_L$ vs. Brewster angle characteristics with $n_H$ as its parameter, and optical glass of the prism fixed at BK7. FIG. 13(*b*) shows relationships between $n_G$ and b.a. with $n_L$ and $n_H$ as its parameters. The reason why the optical glass of the prism was set at BK7 in FIG. 13(*a*) is because b.a. can increase with a decreasing $n_G$ in FIG. 13(*b*), thereby it is most advantageous for the optical glass of the prism, using a general purpose optical glass with a low refractive index, to be determined at BK7. In general, b.a. can increase with increasing $n_L$ and $n_H$, and a decreasing $n_G$.

Key points to note in fabricating actual PBSs 107 are to optimize the following three items.

(1) Optimization of the apex angle of the prism:

As described above, with an increasing apex angle of the prism, degradation in performance due to a variation in the deflected incident angle $\Theta$ can be reduced. On the other hand, however, increasing of the prism apex angle is followed by decreasing of an effective band, thereby there must be taken a proper balance therebetween.

(2) Optimization of thin film thickness combinations

Normally, as described above, reference thin film thicknesses $d_{H0}$, $d_{L0}$ are determined as follows, but they are still insufficient to fully guarantee a desired performance or compensate for the changes in the incident angles.

$$d_{H0} = \lambda/4/n_H/\cos\Theta_H$$

$$d_{L0} = \Theta/4/n_L/\sin\Theta_L$$

Of the foresaid key factors, one which relates to the thin film thickness, is an increase in the optical path of an incidence light when it enters as deflected. In principle this can be overcome by reducing its thin film thickness from the reference thin film's thickness value. However, since the deflected incidence angle $\Theta$ changes to some marginal extent, a balancing is necessitated in combining plural films with different thicknesses to correspond to the varying deflected incident angle $\Theta$.

(3) Optimization of thin film arrangements

The thin film arrangement of PBS 107 has approximately 30 layers. However, with respect of its multiple interference condition, a thin film layer nearer to the side of light incidence has more influence on the overall performance. A particular film thickness which ensures a desired performance for a particular deflected incident angle $\Theta$ has been set according to the optical path modification as described in (1). Since too great a film thickness is not advantageous from the viewpoint of the manufacturing thereof, it is necessary to balance the number of thin films and the film thickness arrangement.

As the result of the foregoing discussions, we have obtained a simulation result in which an extinction rate exceeding 100 was confirmed over incident angles from 0° to 40°. FIGS. 14(*a*) and 14(*b*) show design data, and FIG. 15(*a*-1) to FIG. 15(*b*-2) show the results of the foregoing designs. In order to obtain an appropriate PBS which ensures an excellent performance, we have conducted design work including all parameters as set forth in the foregoing sections (1) to (2), however, to simplify the explanation, differences in film thicknesses alone will be indicated below. More particularly, calculations are executed under the following conditions that an optical glass of the prism:BK7, $n_L$:$SiO_2$ (n=1.46), $n_H$:ZnS(n=2.3), Brewster angle:54.19°, the number of film thickness: 30 layers, and a use wavelength: 780 nm. The normal design and the new design conditions are the same with respect to the prism specifications, adhesive specifications, antireflection coating film specifications, and adhesive/compensating film specifications, but they are arranged to differ at least in the multilayered film specifications. More specifically, in the normal design, thin films of reference thicknesses $d_{H0}$ and $d_{L0}$ described already are laminated alternatively using 15 layers each, while in the new design, thin films further reduced in thickness relative to the reference thin film thicknesses in terms of ratios of 0.65 $d_{H0}$ and 0.85 $d_{L0}$ are arranged likewise, such that a 0.85 $d_{L0}$ thin film is sandwiched between two 0.65 $d_{H0}$ thin films.

FIGS. 15(*a*)–15(*b*) show the results of the simulations. The abscissas denote incident wave lengths λ while the ordinates denote transmission (Tp, Ts) reflection (Rp, Rs) coefficients of S/P polarization beams. Ideally, it is desired that the following conditions are maintained over the whole wavelength region.

$$Tp=Rs=100\ (\%)$$

$$Rp=Ts=0\ (\%)$$

FIG. 15(*a*) is a result obtained at a polarization incident angle Θ=0 according to a conventional design, and FIG. 15(*b*) is that obtained at a polarization incident angle Θ=40 according to the conventional design. FIG. 15(*c*) is a result obtained according to the new design in which a polarization incident angle Θ=0, and FIG. 15(*d*) is that according to the new design at the polarization incident angle Θ=40. A key point to be noted here in relation to the manufacturing margin is what level of performance can be maintained in the vicinity of the wavelength 780 nm at which it is used (indicated by a thick solid line in the drawings). A wavelength region where at least a margin of approximately 5% must be maintained is shown by a shaded portion which covers the designed wavelength 780 nm±40 nm. Although according to the conventional design the overall performance is degraded significantly with an increasing deflection angle Θ, it is clearly shown that according to the new design a preferred performance is guaranteed even if the deflection angle Θ increases. Through the simulations above, it is learned and concluded as follows:

(1) It is advantageous for any film thickness to shift toward the thinner portion with respect to the reference thin film thickness.

(2) Preferably, two or more different films having different film thickness ratios relative to the reference thin film thickness are combined.

(3) Preferably, film thickness arrangements are arranged such that a film having a larger thickness is interposed between films having a smaller thickness, or sandwiched therebetween.

(4) Preferably, the range of film thickness ratios is 0.5 1.0. Further, it is also advantageous to set as follows with respect to the conventional reference film thicknesses $d_{H0}$ and $d_{L0}$.

$$d_{H0}'=\lambda/4/n_H \times \cos\Theta_H$$

$$d_{L0}'=\lambda/4/n_L \times \sin\Theta_L$$

The same effect is attainable as the normal reference film thickness as to performance. In addition, $d_{H0}'$, $d_{L0}'$, as set above, facilitate manufacture thereof.

Described above are the requirements necessary for the PBS to be able to effectively implement the invention.

A preferred embodiment of the invention applied to a printer will be described in detail in the following.

Figure 16:
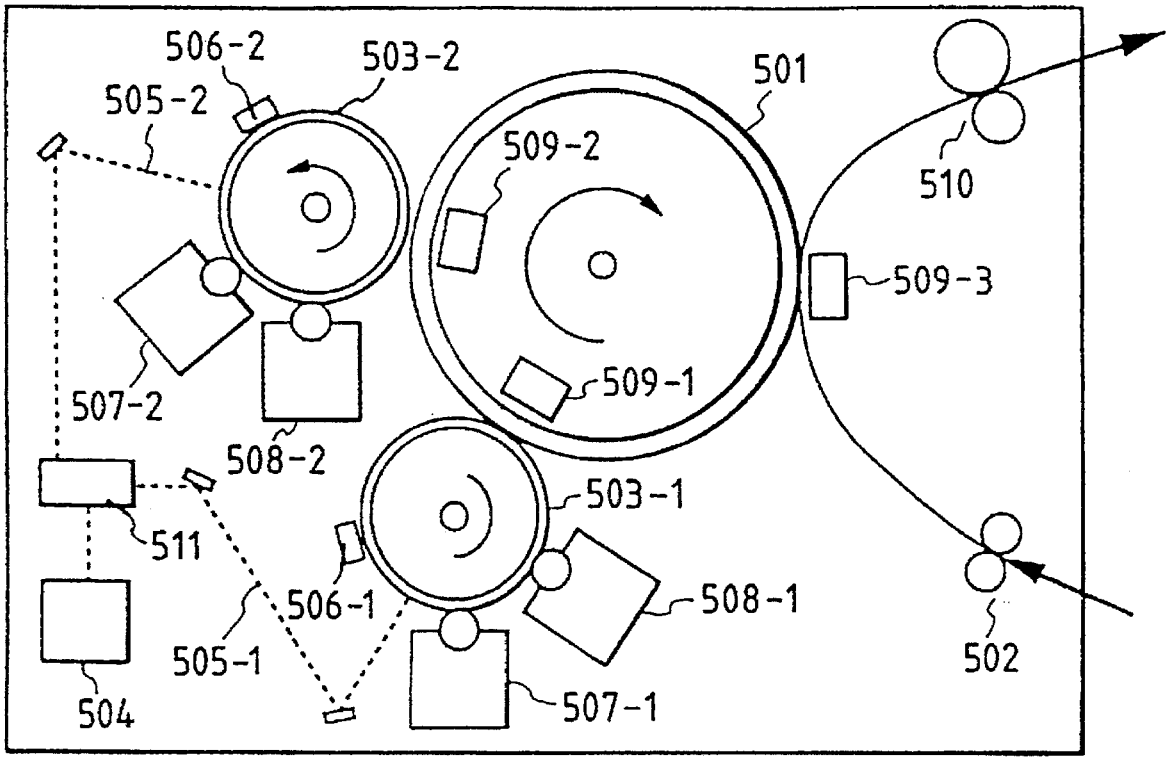
FIG. 16 is a schematic diagram of an exemplary arrangement of an electrophotography apparatus of the invention.

With reference to FIG. 16, a schematic system configuration of a printer embodying the invention is shown, which mainly includes an optical system, a developing system, a transfer system, and a fixing system. Photosensitive drums 503-1, 503-2 are electrically charged by chargers 506-1 and 506-2, then a laser beam generated in an optical system 504, which has been described above, is split into a P polarized beam and an S polarized beam by polarization splitter means, so that split exposure beams 505-1 and 505-2 form a latent image on the drums, respectively. In addition, the optical path lengths of these exposure beams are adjusted by reflection mirrors installed on the output sides of a polarized beam splitter means 511, such that the exposure beams 505-1 and 505-2 travel approximately the same distance. Then, first and second developers 507-1, 507-2 and 508-1, 508-2 develop the latent images on the drums. Since toners with different colors are provided for each developer described above, it is possible to develop and print a multicolored print. Toners on the developed images are transferred by transfer units 509-1 and 509-2 onto an intermediate transfer medium 501. Then, by means of a transfer unit 509-3, the toners are transferred onto a sheet of paper 502 to be fixed thereon by fixing units 510. Although not shown here, this equipment further comprises an optical rotation control means. Further, by arranging in the electrostatic latent image formation for different electrostatic latent images each having a different level of potentials to be formed, it becomes possible to develop at least four colors while the intermediate transfer medium makes one revolution. Further, by use of such arrangements of the invention, it becomes possible to implement a high precision, high speed color printing. Furthermore, the photosensitive body is not limited to the drum as shown in the drawing, but it may be a belt which is provided with an arrangement such that a plurality of developers each having a different color toners are disposed around the belt, the foregoing optical scanning device simultaneously exposing two locations on the belt so as to form a latent image of color corresponding to four color components thereon, and thereby forming a color image to be transferred to a recording sheet during the time the photosensitive body makes one turn.

Next, principles of the color printing according to the invention will be described in detail in the following.

Figure 17:
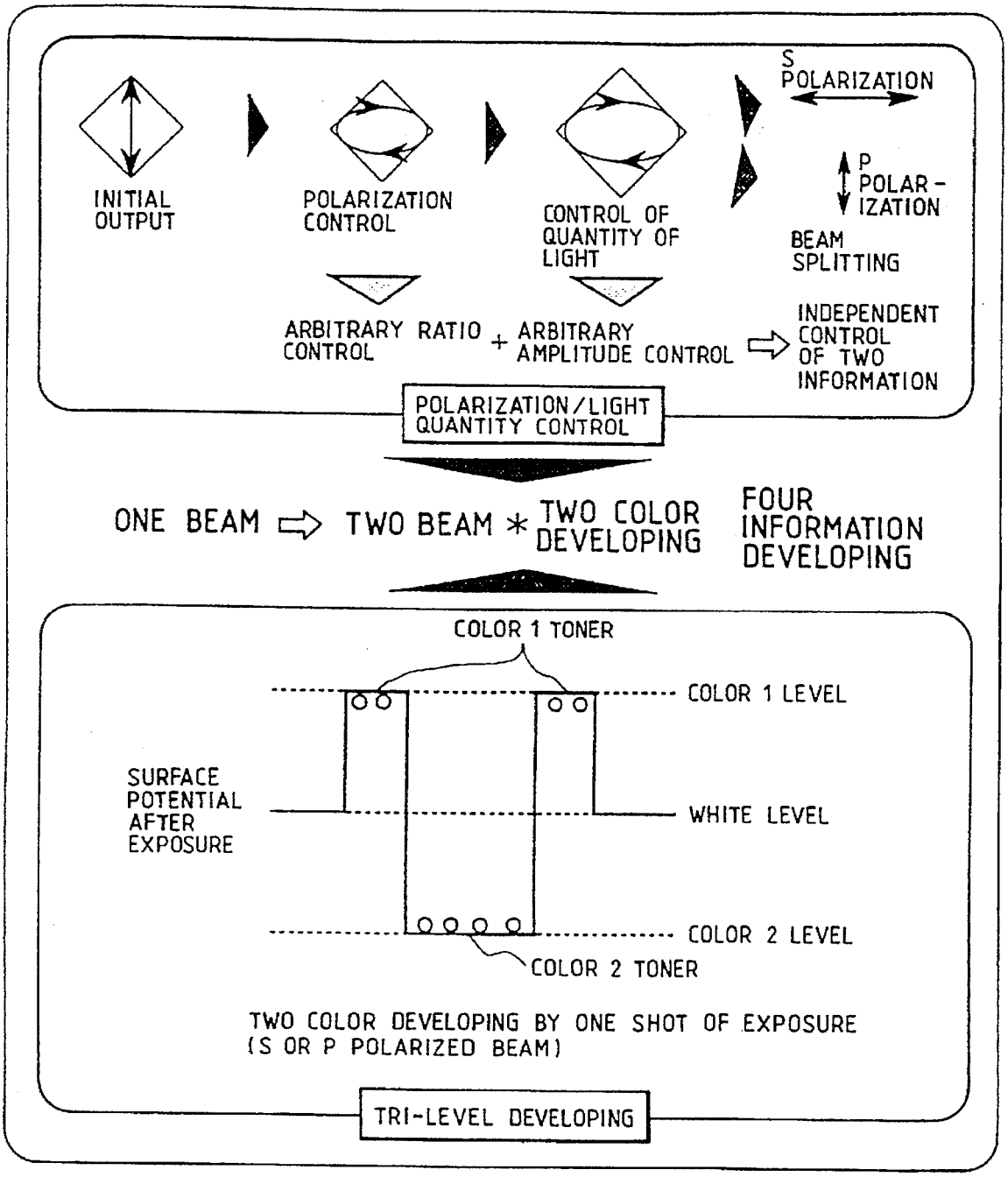
FIG. 17 is a diagram which shows fundamental principles of a one-beam full-color optical system of the invention.

In order to realize a full color, it is necessary to be able to control four units of information relating to yellow, magenta, cyan and black (YMCK) independently of one another. With reference to FIG. 17, there is shown a fundamental operation of the optical system of the invention. This optical system, since it enables a full color printing with a single beam, as will be detailed later, will be referred to as a one beam full color optical system. In this optical system, through control of polarization and light quantity, as shown in the upper portion of FIG. 17, two different units of information within one beam become controllable, and then the beam is split into two beams each carrying different information prior to exposure of the drums. Subsequently, by a tri-level development shown in the lower portion of the drawing, two levels of information are developed with one beam.

First, with respect to the independent control of the two units of information existing in one beam by means of the polarization/light quantity controls, a ratio of S polarization and P polarization is controlled arbitrarily, as described above, by controlling the arbitrary polarization states thereof. Further, by adding to this an arbitrary light quantity control according to the prior art, the magnitude of light is controlled at discretion. Namely, it becomes possible to independently control each of the S and P polarized beams which oscillate in the cross-nichols direction. Finally, they are split into S and P polarized beams each carrying independent information by means of the beam splitter placed in front of their exposure positions.

Secondly, a single beam two information developing system using a tri-level developing method will be described below. Normally, in the development of LP, either of the following methods is employed: a reverse developing in which only the exposed portion is developed with toner, or a normal developing in which only an unexposed portion is developed with toner. The tri-level developing method simultaneously carries out reverse developing and normal developing processes, where two colors are developed from one shot of exposure since, as shown in the drawing, a different color can be developed at each developing level. Further, with respect to an instance where no color or hue is required, a white level is provided at an intermediate exposure level which is free from both the reverse and normal developing. The tri-level is intended to have three levels, two levels of which permit developing, while the other one does not permit developing.

By applying the tri-level developing process to each of the split S and P polarized beams described above, there can be realized 2 beams×2 color developments=4 information developments. According to the optical system of the invention, because of such advantages that a compacter design of the overall optic system is realized by sharing common parts, such as lenses and the like, and that coincidence of optical axes relative to multi-beams is ensured, a high precision optical system which ensures a uniform high precision scanning quality for respective colors and hues can be realized.

Figure 18:
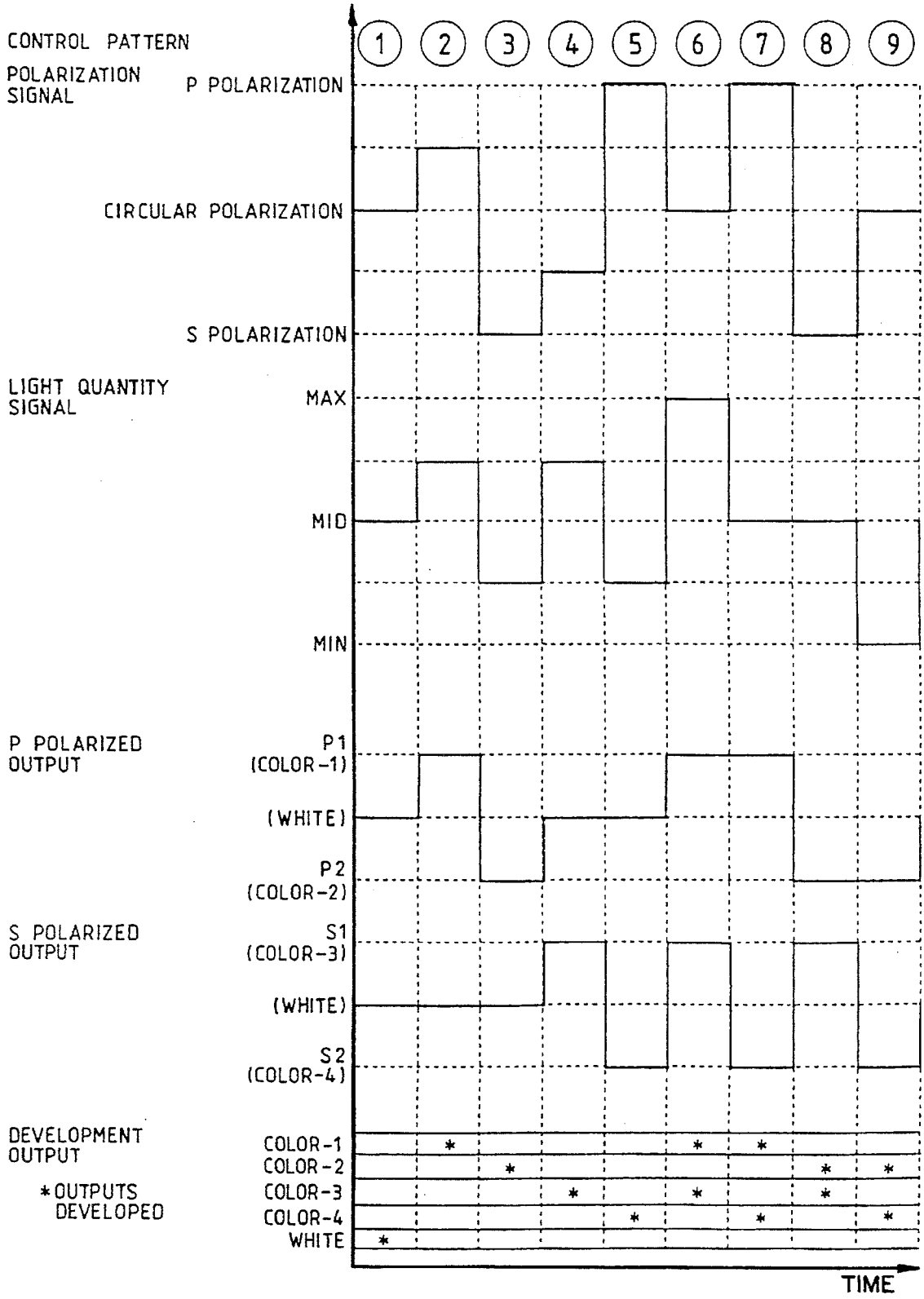
FIG. 18 is a timing diagram which shows examples of input information (polarization/light quantity) and output information (P, S polarized/development) according to the invention.

With reference to FIG. 18, there are shown combinations of the outputs of S and P polarized beams obtained by the polarization/light quantity signal control and colors available for being developed. By way of example, nine control patterns (1)–(9) indicated on the top line are capable of being produced.

More specifically, by controlling the polarization signal/light quantity signal, the outputs of P and S polarized beams are obtained as two separated independent units of information. The P and S polarized outputs have 3 levels of output, respectively, as discussed in the tri-level developing process. In FIG. 18, it is clear that COLOR-1, COLOR-2 will be rendered by the P polarization, and COLOR-3, COLOR-4 will be rendered by the S polarization. As to a polarization signal and a light quantity signal for realizing the foregoing function, the light quantity signal is represented by an addition of the outputs of P and S polarized beams, while the polarization signals represent a polarization quantity required to realize a desired ratio between the P and S polarized beam outputs. According to the control patterns of the invention, developing outputs * as shown in the bottom line in the drawing are obtained. More particularly, color combinations as follows become available. That is, (1): WHITE, (2)–(5): Single color of COLOR-1 through COLOR-4, and (6)–(9): Mixed colors of any two combinations excepting COLOR-1 and COLOR-2, and COLOR-3 and COLOR-4, become possible. It is still difficult to realize a color mixing between two information units carried by a single beam. However, it is possible that one pixel area is divided into two parts where any of two colors corresponding to the single beam are developed respectively, then fused to mix when fixing.

It should be understood that what has been illustrated here represents only some of the basic control quantities, and there should be further applied a proper correction to the quantity of optical rotation in dependence on a deflected incident angle.

By way of example, the result of measurements on the optical system of the invention actually manufactured will be shown below. An exemplary optical system used here employs a $\lambda/4$ plate for its polarization/optical rotation means, the optical axis of which is tilted by 45° relative to the optical axis of the EO device, and which is adjusted to cover the range of wavelengths in use, as described in the optical rotation control method.

Figure 19:
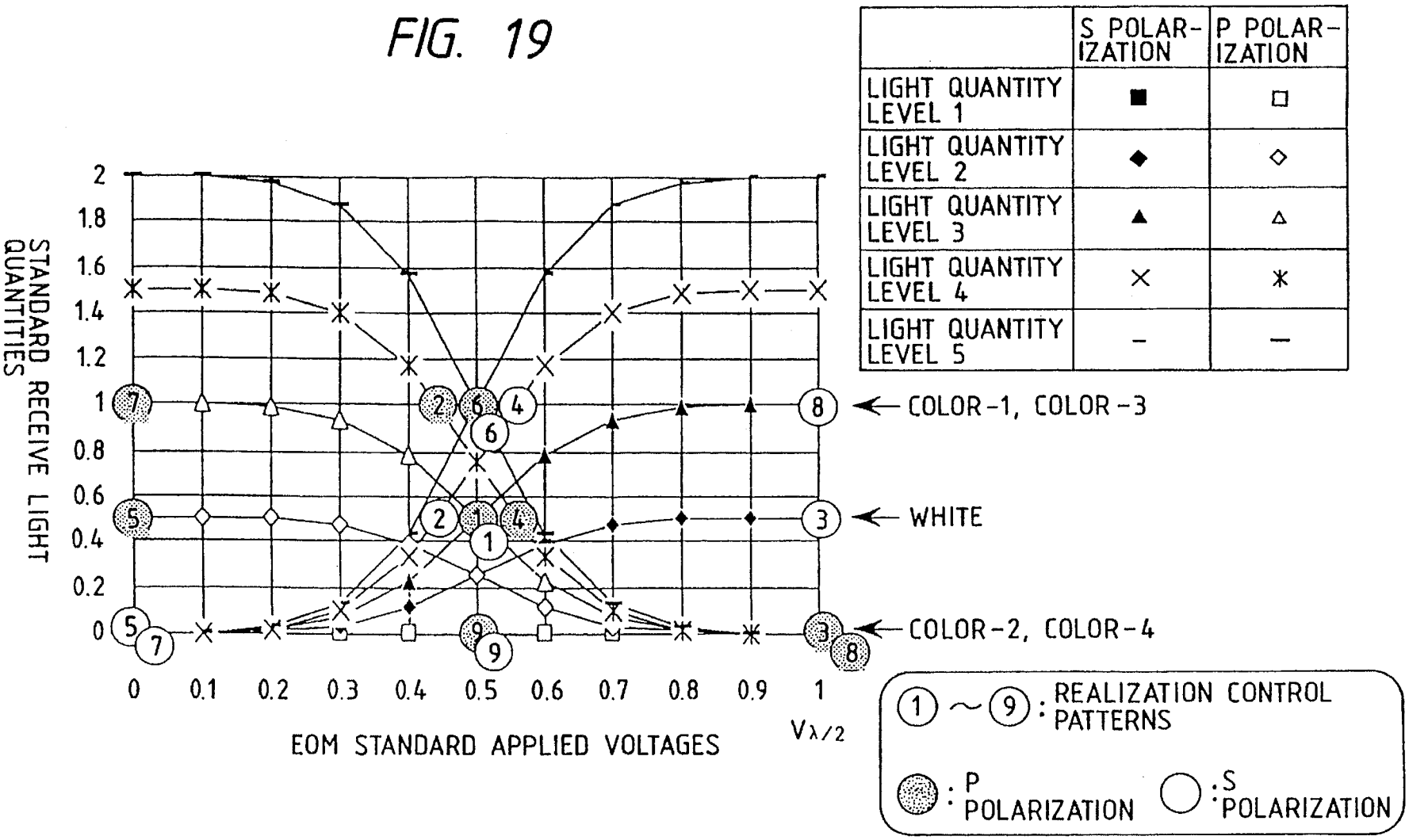
FIG. 19 is a diagram of operations of a one-beam full-color optical system of the invention.

FIG. 19 shows the result of measurements conducted to verify the performance of the single beam full color optical system of the invention, whereby the control patterns described in FIG. 18 are confirmed to have been realized. Electro-Optic Modulator (EOM) standardized applied voltages on the axis of the abscissa denote standardized voltage values when a half wavelength voltage $V_{\lambda/2}$ is set to be 1. Standardized received light quantities on the ordinate represent quantities of light received when the maximum quantity of light of a single beam after being split into S and P polarized beams is specified to be 1. Light quantity levels 1–5 correspond to standardized received light quantities multiplied by 2.0, 1.5, 1.0, 0.5, and 0, respectively. A standardized received light quantity 0 corresponds to the COLOR-2 and COLOR-4 levels in FIG. 18, a quantity 0.5 corresponds to the WHITE level, and a quantity 1 corresponds to the COLOR-1 and COLOR-3 levels. Further, respective control patterns corresponding to 2.5 are shown by (1) through (9). In addition, P polarization outputs are shaded to indicate a distinction from S polarization outputs. As the result of these measurements, the operations of the basic 9 patterns have been confirmed to be obtainable by controlling the light quantities according to 5 levels as well as the polarization quantities according to 5 levels as described in FIG. 18. Further, the light quantities and polarization levels can be varied in an analog mode, whereby the functions and operations discussed here can be enhanced to enable a graduation rendering. To simplify the explanation, the optical rotation correction quantities are omitted from the drawing.

To be noted here with reference to FIG. 19 is an asymmetry of the standardized received light quantities relative to EOM standard applied voltages. Although there still remains a problem in securing the full required precision, assuming a use in a range of 0.7±0.3 of the standard voltage, it is possible to reduce the voltage by as much as 40%. For example, if we use the present EOM with a laser beam at 680 nm, a probable $V_{\lambda/2}$ for a low voltage drive type thereof will be approximately 200 V. In this instance, the load capacity is estimated to be approximately 100 pF. Under such a condition, it is practically impossible to drive to an arbitrary voltage at a high frequency more than 100 MHz according to the present-state-of-art technology. If, however, the drive voltage is reduced to 60% of about 140 V according to the present invention, as large as the load capacity still is, its frequency and drive voltage may fall in a range which can be handled by a video amplifier. Although it is anticipated in the future that driving voltages for the polarization devices will be further reduced to several voltages by implementation of guide waves, laser modulation technologies and others, it is extremely advantageous in such arrangements where bulk devices are employed.

We have described the one beam optical system according to the present invention in detail hereinabove, however, the invention is not limited thereto, and this invention is applicable to any optical system in which the incident angle is variable. Further, it is possible that two beams, after being synthesized into one beam, can be separated once again. More particularly, laser beams emitted from different laser beam sources may be approximately collimated by a collimator lens placed toward the laser beam sources, and thereafter, deflection adjustment may be carried out in a deflection adjustment unit. Then, the respective polarized beams may be caused to enter an optical synthesizer to be formed into one beam of light. This optical synthesizer is composed, for example, of a deflection beam splitter, thereby the deflection adjustment unit controls in such a way that desired quantities of S/P polarization are obtained by the deflection beam splitter 107. The subsequent operations are the same as in FIG. 1. Even in such optical systems, in order to separate the beams using the beam splitter 107 according to their polarization states, a proper optical rotation control becomes necessary.

Figure 20:
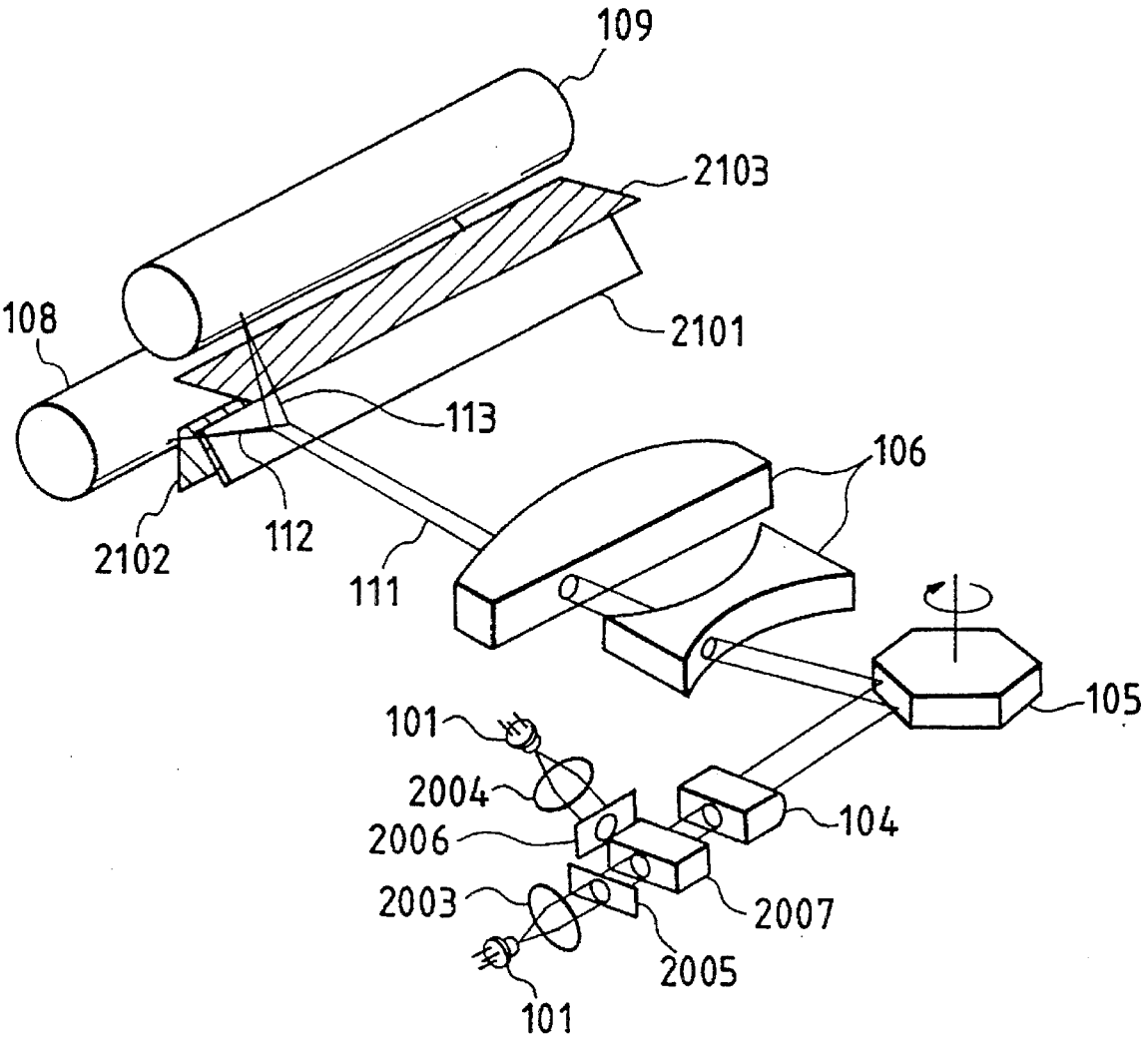
FIG. 20 is a diagram showing an arrangement of a two-beam optical system of the invention.

Finally, with reference to FIG. 20 there is illustrated an optical system of another embodiment of the invention which makes use of two beam sources. For the laser beams emitted from two laser beam sources 101 there are provided, between the laser beam sources and the optical synthesizer 2007, collimator lenses 2003, 2004 which collimate respective beams from the respective laser beam sources, and polarization adjustment members 2005, 2006 which polarize respective beams into a P or S polarized beam. The optical synthesizing unit is composed of a deflected beam splitter similar to the foregoing description. With respect to the other components and parts, they are the same as in FIG. 1 except that the beam splitter 107 is replaced by polarization films 2101, 2103 which allow beams having a cross-nichols relationship with a half mirror 2101 to pass therethrough. In this embodiment of the invention, it might appear that the polarization state has no direct relationship with the beam separation by the half mirror 2101. However, when it is desired to split the P/S polarized beams equivalently, i.e., without depending on their polarization states, by means of a half mirror 2101 which is formed by depositing a metal film or dielectric thin film on an optical glass, an incident angle dependency must be assumed. Thereby, in this instance as well, an appropriate optical rotation control or compensation in dependence on an incident angle is required in order to fully demonstrate its performance.

In conclusion, the advantages and effects of the present invention are applicable to every optical system in which the P.S polarization will change with respect to the reflection surface when viewed from the reflecting side.

As has been described above, an excellent high precision optical system has been implemented by executing a proper optical rotation control or compensation according to a rotation quantity for the polarization coordinates which is defined by the PBS in dependence on the incident angle on the PBS, and by designing the PBS to have a minimized dependence on the incident angle of light as well.

We claim:

1. An optical scanning apparatus comprising a single laser beam source for producing a laser beam, information control means which provides different information for each of two polarized components of said laser beam from said laser beam source, polarizing control means which controls a quantity of polarization of said components of said laser beam on the basis of said information from said information control means to produce a light beam, scanning means for directing toward a predetermined exposure surface and scanning said light beam controlled by said polarizing control means, beam splitter means which separates said scanning light beam into two beams of light according to their states of polarization, and optical rotation control means disposed one of between said polarizing control means and said scanning means and between said scanning means and said beam splitter means, said optical rotation means controlling said laser beam to rotate it corresponding to a changing incident angle at which said scanning light beam from said scanning means enters said beam splitter means.

2. An optical scanning apparatus according to claim 1 wherein, said optical rotation control means comprises a magneto-optic element which controls a quantity of optical rotation by controlling an applied magnetic field.

3. An optical scanning apparatus according to claim 1 wherein, said optical rotation control means comprises a phase compensation film in which a polarizing angle is varied corresponding to an incident position of said scanning light beam.

4. An optical scanning apparatus according to claim 1 wherein, said optical rotation control means comprises a spectroscopic means in which a thin film mount surface angle $\phi$ is defined as follows in order to compensate for an overall performance lowering $55° \leqq \phi \leqq 90°$.

5. An optical scanning apparatus according to claim 1 wherein, said optical rotation control means comprises a polarization means and a linear polarization conversion means for executing a desired optical rotation control.

6. An optical scanning apparatus according to claim 5 wherein, said linear polarization conversion means is a $\lambda/4$ plate which is adjusted to an incident wavelength of light.

7. An optical scanning apparatus according to claim 1 wherein, said beam splitter means comprises a polarized beam splitter which has a dielectric thin film, the thickness of which is shifted toward a thinner direction than the thickness of a reference thin film's thickness.

8. An optical scanning apparatus according to claim 7 wherein, said dielectric thin film comprises multilayered thin films comprising at least two or more films having different film thicknesses, each of which has a film thickness ratio in a range of 0.5–1.0 with respect to the thickness of a reference film.

9. An optical scanning apparatus according to claim 1 wherein, said beam splitter means comprises a pair of prisms having said multilayered thin films interposed between joining surfaces thereof, and wherein an optical film thickness (d) of each thin film constituting said multilayered thin films is smaller than an optical film thickness (d0) at which an optical path length of an energy beam which enters at a Brewster angle of incidence becomes approximately $\lambda 0/4$.

10. An electrophotographic apparatus having a photosensitive member, a charger for uniformly charging the surface of said photosensitive member, an optical scanning apparatus which, in order to form an electrostatic latent image on the surface of said photosensitive member, exposes two positions concurrently with laser beams on the surface of said photosensitive member which has been uniformly charged by said charger, a plurality of developers for developing the electrostatic latent image formed by said optical scanning apparatus with toners of different colors, transfer means for transferring a toner image thusly developed onto a recording medium, and fixing means for fixing said toner image thusly transferred on the recording medium, wherein said optical scanning apparatus comprises a single laser beam source for producing a laser beam, information control means which imparts different information for each of two polarized beams of said laser light from said laser source, polarization of said components of said laser beam on the basis of said information from said information to control means to produce a light beam, scanning means for directing toward and scanning said surface of said photosensitive member said polarization controlled beam for exposing said surface, a beam splitter for splitting the scanned polarization controlled beam into two beam components, and optical rotation means which controls said laser beam to optically rotate it corresponding to an incident angle at which the scanned polarization controlled beam from said scanning means enters said beam splitter means, the optical rotation means being interposed between said polarization control means and said scanning means.

11. The optical scanning apparatus of claim 1, where said two beams impinge on different photoconductive surfaces.

12. The optical scanning apparatus of claim 1, wherein said two beams impinge on different positions of a single photoconductive surface.

13. The optical scanning apparatus of claim 1, further comprising:

signal generating means for generating a first signal indicative of a position on a photoconductive surface on which at least one of said two beams is scanned, said optical rotation control means controlling the rotation of said light beam based on said signal.

* * * * *